US010921736B2

(12) United States Patent
Iwasaki

(10) Patent No.: US 10,921,736 B2
(45) Date of Patent: Feb. 16, 2021

(54) IMAGE HEATING APPARATUS AND IMAGE FORMING APPARATUS

(71) Applicant: CANON KABUSHIKI KAISHA, Tokyo (JP)

(72) Inventor: Atsushi Iwasaki, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/510,086

(22) Filed: Jul. 12, 2019

(65) Prior Publication Data

US 2020/0026227 A1 Jan. 23, 2020

(30) Foreign Application Priority Data

Jul. 19, 2018 (JP) ..... JP2018-135990

(51) Int. Cl.
*G03G 15/20* (2006.01)

(52) U.S. Cl.
CPC ..... *G03G 15/2039* (2013.01); *G03G 15/2042* (2013.01); *G03G 15/2053* (2013.01); *G03G 2215/2003* (2013.01); *G03G 2215/2006* (2013.01)

(58) Field of Classification Search
CPC ..... G03G 15/2039; G03G 15/2053; G03G 2215/2003; G03G 2215/2006; G03G 15/2042
See application file for complete search history.

(56) References Cited

U.S. PATENT DOCUMENTS 7,193,181 B2 3/2007 Makihira et al.
7,283,145 B2 10/2007 Kato et al.
8,909,084 B2 * 12/2014 Fujii ..... G03G 15/2042 399/330
10,114,318 B2 10/2018 Sako et al.
10,185,258 B2 1/2019 Sako et al.
10,254,689 B2 4/2019 Nomura et al.
(Continued)

FOREIGN PATENT DOCUMENTS

EP 0604976 A1 * 7/1994 ..... G03G 15/2053
JP 2015-194713 A 11/2015
(Continued)

OTHER PUBLICATIONS

Copending, unpublished, U.S. Appl. No. 16/411,795 to Naoto Tsuchihashi filed May 14, 2019.

*Primary Examiner* — Ryan D Walsh
(74) *Attorney, Agent, or Firm* — Venable LLP

(57) ABSTRACT

A first temperature detecting member is arranged in a longitudinal direction of a heater at a position that is (i) in a vicinity of an end adjacent to a second heating element among ends in the longitudinal direction of a first heating element, and (ii) separated from a reference passing position with respect to a recording material end that passes near a boundary between the first heating element and the second heating element by at least 2.5 mm toward a side close to a transport reference position, and a second temperature detecting member is arranged in the longitudinal direction at a position that is (iii) in a vicinity of an end adjacent to the first heating element among ends in the longitudinal direction of the second heating element, and (iv) separated from the reference passing position by at least 2.5 mm toward a side far from the transport reference position.

16 Claims, 14 Drawing Sheets

(56) References Cited

U.S. PATENT DOCUMENTS

| | | | | |
|---|---|---|---|---|
| 10,338,505 | B2 | 7/2019 | Nomura et al. | |
| 10,416,595 | B2 * | 9/2019 | Ogura | G03G 15/2053 |
| 2017/0075267 | A1 * | 3/2017 | Yoshimura | G03G 15/2039 |
| 2017/0075268 | A1 * | 3/2017 | Ogura | G03G 15/2053 |
| 2017/0075269 | A1 * | 3/2017 | Iwasaki | G03G 15/2053 |
| 2017/0102650 | A1 | 4/2017 | Shimura et al. | |
| 2018/0004134 | A1 * | 1/2018 | Nomura | G03G 15/2042 |
| 2018/0004135 | A1 * | 1/2018 | Sako | G03G 15/2053 |
| 2018/0004136 | A1 * | 1/2018 | Iwasaki | G03G 13/20 |
| 2018/0032008 | A1 * | 2/2018 | Sako | G03G 15/2042 |
| 2018/0157003 | A1 | 6/2018 | Tsuchihashi et al. | |
| 2018/0253041 | A1 * | 9/2018 | Uchiyama | H05B 3/20 |
| 2018/0253043 | A1 | 9/2018 | Shimura et al. | |
| 2018/0335731 | A1 * | 11/2018 | Ogura | G03G 15/205 |
| 2018/0335737 | A1 * | 11/2018 | Ogura | G03G 15/2053 |
| 2019/0049881 | A1 | 2/2019 | Sako et al. | |
| 2019/0107801 | A1 | 4/2019 | Sako et al. | |
| 2019/0155199 | A1 * | 5/2019 | Saito | G03G 15/5004 |
| 2019/0212679 | A1 * | 7/2019 | Aiba | G03G 15/5004 |
| 2019/0227466 | A1 | 7/2019 | Nomura et al. | |
| 2019/0271933 | A1 | 9/2019 | Nomura et al. | |
| 2019/0369534 | A1 * | 12/2019 | Nishikata | G03G 15/2039 |
| 2019/0391515 | A1 * | 12/2019 | Shimura | G03G 15/2053 |
| 2019/0391516 | A1 * | 12/2019 | Ogura | G03G 15/2053 |

FOREIGN PATENT DOCUMENTS

| | | | | |
|---|---|---|---|---|
| JP | 2017-054071 | A | 3/2017 | |
| JP | 2017-173583 | A | 9/2017 | |
| JP | 2018-092038 | A | 6/2018 | |
| JP | 2018-105986 | A | 7/2018 | |
| WO | WO-2015141217 | A1 * | 9/2015 | G03G 15/2053 |
| WO | WO-2017043020 | A1 * | 3/2017 | H05B 3/0095 |

* cited by examiner

IMAGE HEATING APPARATUS AND IMAGE FORMING APPARATUS

BACKGROUND OF THE INVENTION

Field of the Invention

The present invention relates to an image forming apparatus such as a printer, a copier, a facsimile machine, or the like which uses an electrophotographic system or an electrostatic recording system. The present invention also relates to an image heating apparatus such as a fixing unit mounted to an image forming apparatus, a gloss imparting apparatus which reheats a toner image fixed to a recording material in order to improve a gloss value of the toner image, or the like. The present invention also relates to a heater used in the image heating apparatus.

Description of the Related Art

There is an image heating apparatus which includes a cylindrical film, a heater that comes into contact with an inner surface of the film, and a roller that forms a nip portion together with the heater via the film. Image forming apparatuses mounted with the image heating apparatus are known to have a problem of a so-called non-paper-passing portion temperature rise. A non-paper-passing portion temperature rise refers to a phenomenon where, when a recording material (a small-size recording material) with a narrow width relative to a maximum paper-passing width in a direction (a recording material width direction) which is perpendicular to a transport direction of the recording material is consecutively printed, a temperature of a region (a non-paper-passing portion) in a nip portion which the recording material does not pass through gradually rises. Since the image heating apparatus must ensure that the temperature of the non-paper-passing portion does not exceed an upper temperature limit of each member inside the apparatus, a method of suppressing the non-paper-passing portion temperature rise by reducing throughput (the number of sheets of paper that can be passed per minute) of consecutive printing is often used. As a method of suppressing the non-paper-passing portion temperature rise, an apparatus is proposed in which a heating resistor on a heater is divided into a plurality of groups (heating blocks) in the recording material width direction and a heating distribution (heated regions) of the heater is switched in accordance with a size of a recording material (Japanese Patent Application Laid-open No. 2015-194713). In addition, an apparatus is proposed in which dividing positions of a heating block are arranged in accordance with ends (recording material ends) in a direction perpendicular to a transport direction of a plurality of standard-size recording materials such as A4, B5, and A5 and a heating distribution of a heater is switched with respect to the standard-size recording materials (Japanese Patent Application Laid-open No. 2017-54071).

SUMMARY OF THE INVENTION

However, there may be cases where fixing control must be performed in a state where one of left and right ends of a recording material passes a position that does not match a dividing position of the heating block as in the case of non-standard-size recording materials. When the image heating apparatus described in Japanese Patent Application Laid-open No. 2015-194713 is used in such a case, faulty fixing of an image may occur near the end of the recording material or it may become difficult to protect the image heating apparatus from an excessive temperature rise caused by a non-paper-passing portion temperature rise due to a heating block jutting out into a non-paper-passing portion. In addition, when using the image heating apparatus described in Japanese Patent Application Laid-open No. 2017-54071, control of an amount of heat generation with respect to a heating block near a recording material end may become unstable due to a standard-size recording material shifting leftward or rightward from a standard travel position during transport of the standard-size recording material.

An object of the present invention is to provide a technique which enables temperature control of a heater that selectively heats a plurality of heated regions to be stabilized.

In order to achieve the object described above, an image heating apparatus according to the present invention includes:

- a heater including a plurality of heating elements arranged in a direction that is perpendicular to a transport direction of a recording material;
- a plurality of temperature detecting members for detecting a temperature of a plurality of heated regions that are independently heated by each of the plurality of heating elements; and
- a control portion which individually controls power to be supplied to the plurality of heating elements so that the temperature detected by the temperature detecting members is maintained at a prescribed control target temperature,
- wherein the plurality of heating elements include a first heating element and a second heating element arranged adjacent to the first heating element on a side farther from a transport reference position of the recording material than the first heating element in the direction perpendicular to the transport direction,
- wherein the plurality of temperature detecting members include a first temperature detecting member provided in correspondence with the first heating element and a second temperature detecting member provided in correspondence with the second heating element,
- wherein the first temperature detecting member is arranged in the direction, that is perpendicular to the transport direction, at a position that is (i) in a vicinity of an end adjacent to the second heating element among ends in the direction, that is perpendicular to the transport direction, of the first heating element, and (ii) separated from a prescribed reference passing position with respect to a recording material end that passes near a boundary between the first heating element and the second heating element by at least 2.5 mm toward a side close to the transport reference position, and
- wherein the second temperature detecting member is arranged in the direction, that is perpendicular to the transport direction, at a position that is (iii) in a vicinity of an end adjacent to the first heating element among ends in the direction, that is perpendicular to the transport direction, of the second heating element, and (iv) separated from the reference passing position by at least 2.5 mm toward a far side from the transport reference position from the reference passing position.

In order to achieve the object described above, an image heating apparatus according to the present invention includes:

- a heater including a plurality of heating elements arranged in a direction that is perpendicular to a transport direction of a recording material;

a plurality of temperature detecting members for detecting a temperature of a plurality of heated regions that are independently heated by each of the plurality of heating elements; and a control portion which individually controls power to be supplied to the plurality of heating elements so that the temperature detected by the temperature detecting members is maintained at a prescribed control target temperature, wherein the plurality of heating elements include a first heating element and a second heating element arranged adjacent to the first heating element on a far side from a transport reference position of the recording material than the first heating element in the direction perpendicular to the transport direction, wherein the plurality of temperature detecting members include a first temperature detecting member provided in correspondence with the first heating element and a second temperature detecting member provided in correspondence with the second heating element, wherein the first temperature detecting member is arranged in the direction, that is perpendicular to the transport direction, at a position that is (i) in a vicinity of an end adjacent to the second heating element among ends in the direction, that is perpendicular to the transport direction, of the first heating element, and (ii) separated from a prescribed reference passing position with respect to a recording material end that passes near a boundary between the first heating element and the second heating element by at least a first distance toward a side close to the transport reference position, and wherein the second temperature detecting member is arranged in the direction, that is perpendicular to the transport direction, at a position that is (iii) in a vicinity of an end adjacent to the first heating element among ends in the direction, that is perpendicular to the transport direction, of the second heating element, and (iv) separated from the reference passing position by at least a second distance toward a side far from the transport reference position.

In order to achieve the object described above, an image forming apparatus according to the present invention includes:

an image forming portion which forms an image on a recording material; and a fixing portion which fixes an image formed on the recording material to the recording material, wherein the fixing portion is the image heating apparatus according to the present invention.

According to the present invention, temperature control of a heater that selectively heats a plurality of heated regions can be stabilized.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 1:
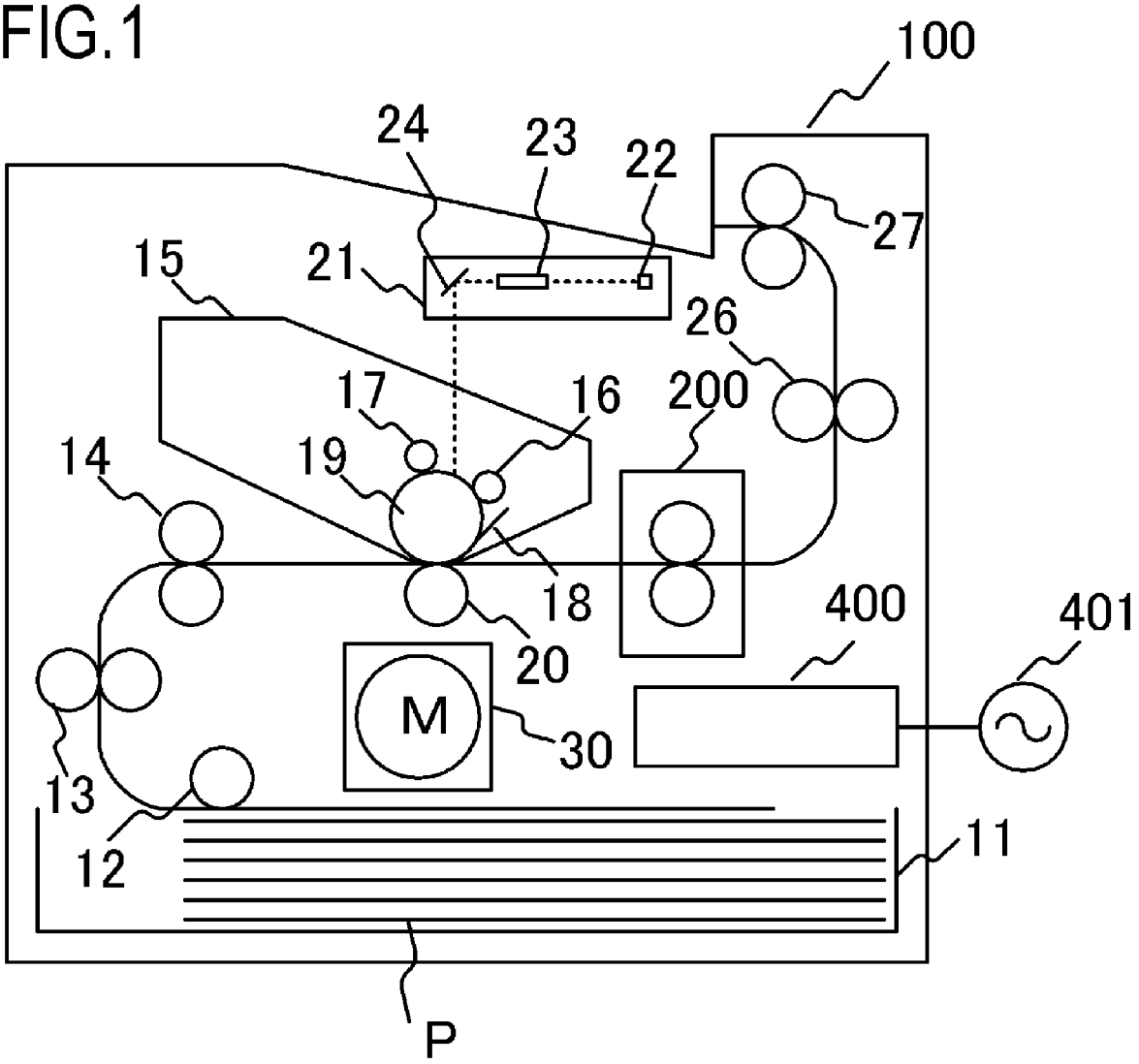
FIG. 1 is a sectional view of an image forming apparatus according to an embodiment of the present invention.

FIG. 1 is a sectional view of a laser printer (an image forming apparatus) 100 using an electrophotographic recording technique. Examples of image forming apparatuses to which the present invention is applicable include printers, copiers, and facsimile machines which utilize an electrophotographic system or an electrostatic recording system, and a case where the present invention is applied to a laser printer that uses an electrophotographic system to form images on a recording material P will be described below.

It should be noted that, unless noted to the contrary, a "longitudinal direction" in the following description is a same direction as a longitudinal direction of a heater (substrate) and a direction perpendicular to a transport direction of a recording material (a width direction of an unskewed recording material, a short-side direction of a longitudinally transported unskewed recording material). In addition, a "transverse direction" is a direction perpendicular to the "longitudinal direction" described above and is a same direction as a direction parallel to the transport direction of a recording material (a length direction of an unskewed recording material, a long-side direction of a longitudinally transported unskewed recording material).

When a print signal is generated, a scanner unit 21 emits laser light modulated in accordance with image information to scan a photosensitive member (a photosensitive drum) 19 charged to a prescribed polarity by a charging roller 16. Accordingly, an electrostatic latent image is formed on the photosensitive member 19. The electrostatic latent image is supplied with toner (a developer) from a developing device (a developing roller) 17 and a toner image (a developer image) in accordance with the image information is formed on the photosensitive member 19. Meanwhile, a recording material (a recording paper) P stacked in a paper feeding cassette 11 is fed one by one by a pickup roller 12, and transported toward a resist roller 14 by a roller 13. Furthermore, the recording material P is transported in synchronization with the arrival of the toner image on the photosensitive member 19 at a transfer portion formed by the photosensitive member 19 and a transfer roller 20 from the resist roller 14 to the transfer portion. The toner image on the photosensitive member 19 is transferred to the recording material P as the recording material P passes the transfer portion. Subsequently, the recording material P is heated by a fixing apparatus (an image heating apparatus) 200 as a fixing portion (an image heating portion) and the toner image is fixed by heat to the recording material P. The recording material P bearing the fixed toner image is discharged to a tray in an upper part of the laser printer 100 by rollers 26 and 27.

Toner remaining on the photosensitive drum 19 after transfer of the toner image to the recording material P is cleaned by a cleaner 18. A laser scanner has a light source 22, a polygonal mirror 23, and a reflective mirror 24. The laser printer 100 has a motor 30 which drives the fixing apparatus 200 and the like. A control circuit 400 as heater driving means and an energization control portion connected to a commercial AC power supply 401 supplies power to the fixing apparatus 200. The photosensitive member 19, the charging roller 16, the scanner unit 21, the developing device 17, and the transfer roller 20 described above constitute an image forming portion which forms an unfixed image on the recording material P. In addition, in the present embodiment, a developing unit including the photosensitive member 19, the charging roller 16, and the developing device 17 and a cleaning unit including the cleaner 18 are configured as a process cartridge 15 that is attachable to and detachable from an apparatus main body of the laser printer 100.

The printer according to the present embodiment is a laser printer that basically longitudinally feeds the recording material P (transports the recording material P so that a long side of the recording material P is parallel to the transport direction). In addition, the printer according to the present embodiment is a center-referenced printer that transports the recording material P so that a center of the recording material P in a paper width direction (a direction perpendicular to the transport direction of the recording material P) is aligned with a transport reference position. It should be noted that the configuration according to the present proposal can also be applied to a printer that transversely feeds paper. Furthermore, recording materials with a largest (widest) width among widths of standard-size recording materials (nominal widths of recording materials) accommodated by the apparatus are Letter paper and Legal paper which have a width of 215.9 mm. In the present embodiment, a printer with a transport speed of the recording material P and an image forming speed of 240 mm/sec is used.

The printer according to the present embodiment accommodates a plurality of recording material sizes, and Letter paper (215.9 mm×279.4 mm) and Legal paper (215.9 mm×355.6 mm) can be set to the paper feeding cassette 11. A4 paper (210 mm×297 mm), B5 paper (182 mm×257 mm), and A5 paper (148 mm×210 mm) can also be set.

In addition, when the recording material P is transported from the paper feeding portion to the fixing portion, the printer according to the present embodiment allows a travel position shift of up to ±2.5 mm relative to a standard travel position in a width direction of the recording material P. For convenience's sake, a + side is assumed to be a direction of separation from the transport reference position and a − side is assumed to be a direction of approach to the transport reference position. As a breakdown of the travel position shift, a travel position shift (a shift of an image write start position on the recording material P) from the paper feeding portion to the transfer portion is allowed up to ±2 mm. In addition, a travel position shift (a shift of a recording material position due to skew of the recording material P after transfer) from the transfer portion to the fixing portion is allowed up to ±0.5 mm on the assumption that a transport distance from the transfer portion to the fixing portion is approximately 70 mm.

Figure 2:
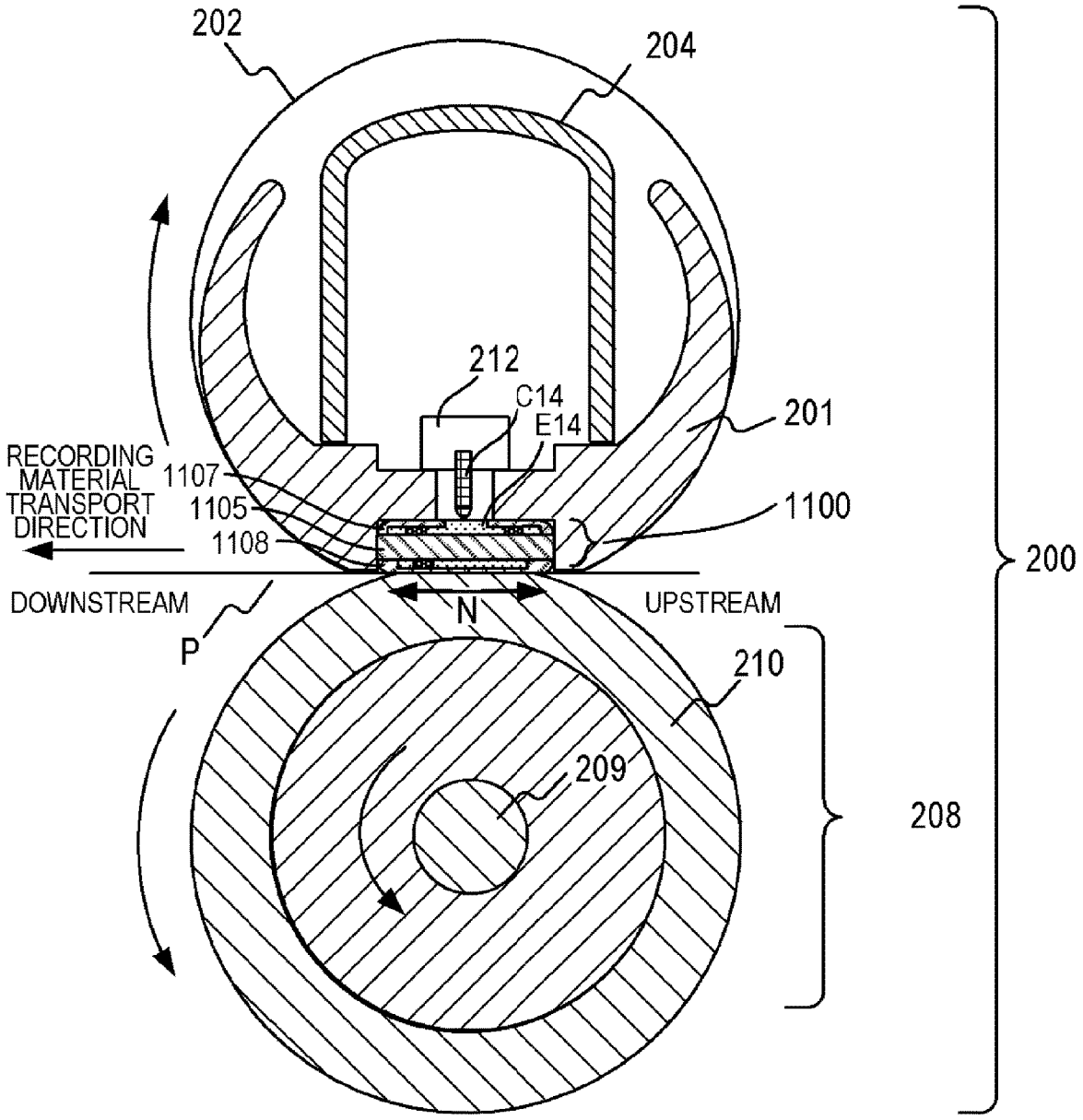
FIG. 2 is a sectional view of an image heating apparatus according to an embodiment of the present invention.

FIG. 2 is a schematic sectional view of the fixing apparatus 200 according to the present embodiment. The fixing apparatus 200 includes a cylindrical film 202, a heater 1100 in contact with an inner surface of the film 202, and a pressure roller (a nip portion-forming member) 208 which forms a fixing nip portion N together with the heater 1100 via the film 202. A material of a base layer of the film 202 is a heat-resistant resin such as polyimide or a metal such as stainless steel. In addition, the film 202 may be provided with an elastic layer made of heat-resistant rubber or the like. The pressure roller 208 includes a core metal 209 made of a material such as iron or aluminum and an elastic layer 210 made of a material such as silicone rubber. The heater 1100 is held by a holding member 201 made of a heat-resistant resin such as liquid crystal polymer. The holding member 201 also has a guiding function for guiding rotation of the film 202. The pressure roller 208 rotates in a direction of an arrow in FIG. 2 due to power received from a motor 30. The rotation of the pressure roller 208 is followed by a rotation of the film 202. The recording material P bearing an unfixed toner image is subjected to a fixing process by heating while being sandwiched and transported by the fixing nip portion N. As described above, the apparatus 200 includes the cylindrical film 202 and the heater 1100 in contact with the inner surface of the film 202, and heats an image formed on a recording material using heat of the heater 1100 via the film 202.

The heater 1100 includes a ceramic substrate 1105 and a heating resistor (a heating element) (refer to FIGS. 3A to 3C) which is provided on the substrate 1105 and which generates heat when supplied with power. A glass surface protection layer 1108 is provided on a surface (a heater sliding surface) of the substrate 1105 on a side of the fixing nip portion N in order to ensure slidability of the film 202. A glass surface protection layer 1107 is provided on a surface (a heater back surface) of the substrate 1105 on an opposite side of the side of the fixing nip portion N in order to insulate the heating resistor. An electrode (in this case, E14 is representatively shown) is exposed on the heater back surface, and the heating resistor is electrically connected to the commercial AC power supply 401 when a power-supplying electrical contact (in this case, C14 is representatively shown) comes into contact with the electrode. Details of the heater 1100 will be provided later.

A protective element 212 which is a thermo switch, a thermal fuse, or the like is actuated by abnormal heating of the heater 1100 and interrupts power supplied to the heater 1100. The protective element 212 is either in contact with the heater 1100 or arranged such that a small gap is provided between the protective element 212 and the heater 1100. A metal stay 204 is for applying pressure of a spring (not illustrated) to the holding member 201 but also reinforces the holding member 201 and the heater 1100.

Figure 3A:
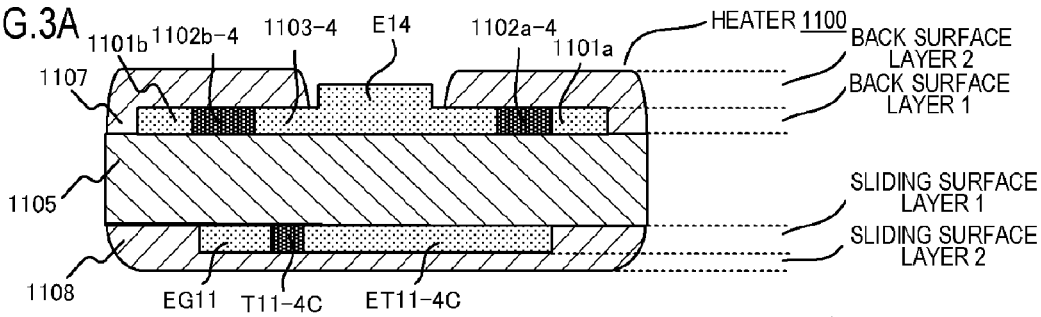
FIGS. 3A to 3C are heater configuration diagrams according to a first embodiment.
Figure 3B:
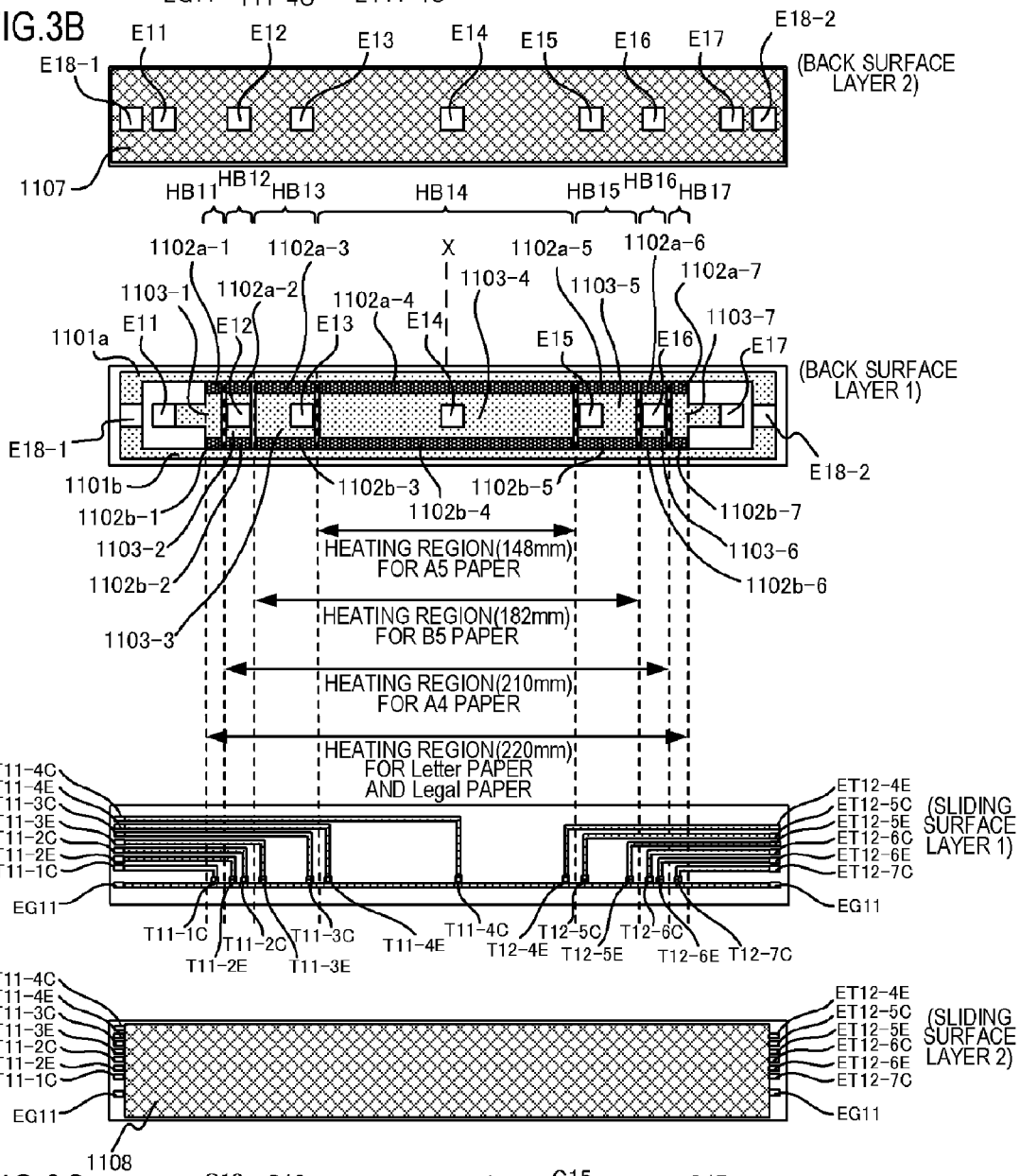
Figure 3C:
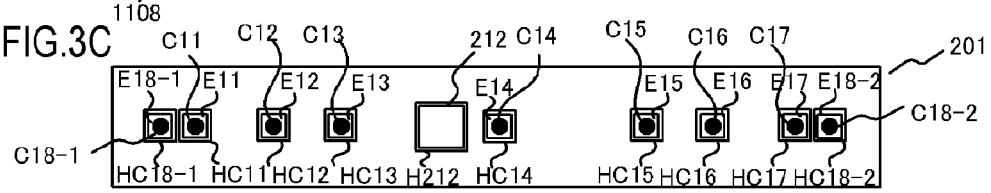

FIGS. 3A, 3B, and 3C are schematic views showing a configuration of the heater 1100 according to the first embodiment. FIG. 3A is a sectional view of the heater 1100 in a vicinity of a transport reference position X of the recording material P shown in FIG. 3B. FIG. 3B shows plan views of the respective layers of the heater 1100. FIG. 3C is a plan view of a holding member that holds the heater 1100.

A configuration of the heater 1100 will now be described in detail. A heating block made of a set constituted by a first conductor 1101, a second conductor 1103, and a heating resistor (a heating element) 1102 is provided in plurality in a longitudinal direction of the heater 1100 on a back surface layer 1 of the heater 1100 which is a heater surface on an opposite side of a heater surface in contact with the film 202. The heater 1100 according to the present embodiment has a total of seven heating blocks HB11 to HB17. Control of heating blocks will be described later.

Each heating block includes the first conductor 1101 which is provided along a longitudinal direction of the substrate 1105 and the second conductor 1103 which is provided along the longitudinal direction of the substrate at a different position from the first conductor 1101 in a transverse direction that is perpendicular to the longitudinal direction of the substrate. Furthermore, the heating resistor 1102 is provided between the first conductor 1101 and the second conductor 1103 and generates heat due to power supplied via the first conductor 1101 and the second conductor 1103.

The heating resistor 1102 of each heating block is divided in the transverse direction of the heater 1100 into a heating resistor 1102*a* and a heating resistor 1102*b* which are formed at mutually symmetrical positions with respect to a center of the substrate. In addition, the first conductor 1101 is divided into a conductor 1101*a* which is connected to the heating resistor 1102*a* and a conductor 1101*b* which is connected to the heating resistor 1102*b*. The heating resistor 1102*a* and the heating resistor 1102*b* are formed at mutually symmetrical positions with respect to the center of the substrate.

Since the heater 1100 includes the seven heating blocks HB11 to HB17, the heating resistor 1102*a* is divided into seven heating resistors 1102*a*-1 to 1102*a*-7. In a similar manner, the heating resistor 1102*b* is divided into seven heating resistors 1102*b*-1 to 1102*b*-7. Furthermore, the second conductor 1103 is also divided into seven conductors 1103-1 to 1103-7. The heating resistors 1102*a*-1 to 1102*a*-7 are arranged on an upstream side in the transport direction of the recording material P in the substrate 1105 while the heating resistors 1102*b*-1 to 1102*b*-7 are arranged on a downstream side in the transport direction of the recording material P in the substrate 1105.

A heating region (a heated region) of each heating block will now be described.

As shown in FIG. 3B, the heating region of each heating block is set so as to match a width of a representative standard size relative to the transport reference position X. The heating region of the heating block HB14 arranged at a longitudinal center of the heater 1100 is set to 148 mm which is a width when an A5 size is being longitudinally transported. In addition, a heating region including the heating block HB13 and the heating block HB15 which are arranged on outer sides of the heating block HB14 are set to 182 mm which is a width when a B5 size is being longitudinally transported. A heating region including the heating block HB12 and the heating block HB16 which are arranged on further outer sides are set to 210 mm which is a width when an A4 size is being longitudinally transported. A width of all heating blocks including the heating block HB11 and the heating block HB17 is set to 220 mm which is wider than the Letter size (approximately 216 mm) in consideration of an effect of a temperature drop due to heat dissipation at ends.

A back surface layer 2 of the heater 1100 is provided with the insulating (in the present embodiment, glass) surface protection layer 1107 which covers the heating resistor 1102, the first conductor 1101, and the second conductor 1103. However, the surface protection layer 1107 does not cover the electrode E11 to E17, E18-1, and E18-2 with which the power-supplying electrical contacts C11 to C17, C18-1, and C18-2 come into contact. The electrodes E11 to E17 are, respectively, electrodes for supplying power to the heating blocks HB11 to HB17 via the second conductors 1103-1 to 1103-7. The electrodes E18-1 and E18-2 are electrodes for supplying power to the heating blocks HB11 to HB17 via the first conductors 1101*a* and 1101*b*.

Since a resistance value of a conductor is not zero, the conductor affects a distribution of heat generation in the longitudinal direction of the heater 1100. In consideration thereof, the electrodes E18-1 and E18-2 are provided separately at both ends in the longitudinal direction of the heater 1100 so that the distribution of heat generation does not become nonuniform even when affected by the electric resistances of the first conductors 1101*a* and 1101*b* and the second conductors 1103-1 to 1103-7.

As shown in FIG. 3C, the holding member 201 is provided with holes HC11 to HC17, HC18-1, and HC18-2 through which are passed the electrical contacts C11 to C17, C18-1, and C18-2 to be connected to the electrodes E11 to E17, E18-1, and E18-2. In addition, the holding member 201 is also provided with a hole H212 through which a heat sensing portion of the protective element 212 is passed. The electrical contacts C11 to C17, C18-1, and C18-2 are electrically connected to corresponding electrodes by a method such as biasing by a spring or welding. The protective element 212 is also biased by a spring and the heat sensing portion thereof is in contact with the surface protection layer 1107. Each electrical contact is connected to the control circuit 400 of the heater 1100 via a conductive member such as a cable or a thin metal plate provided in a space between the stay 204 and the holding member 201.

By independently controlling each of the plurality of heating blocks, the heater 1100 according to the present embodiment is capable of individually heating heated regions formed in plurality in the longitudinal direction and forming various distributions of heat generation. For example, distributions of heat generation in accordance with recording material sizes can be set. Furthermore, the heating resistor 1102 is formed by a material having a positive temperature coefficient (PTC). Using a material having PTC enables a temperature rise of a non-paper-passing portion to be suppressed even in cases where an end of a recording material does not match a boundary between heating blocks.

A plurality of thermistors T11-1C to T11-4C, T11-2E to T11-4E, T12-5C to T12-7C, and T12-4E to T12-6E are formed on a sliding surface layer 1 on a side of the sliding surface (the surface on a side that comes into contact with film) of the heater 1100. The thermistors T11-1C to T11-4C, T11-2E to T11-4E, T12-5C to T12-7C, and T12-4E to T12-6E are temperature detecting members (temperature detecting elements) for detecting temperatures of the respective heating blocks HB11 to HB17. A material of the thermistors need only be a material with a large positive or negative temperature coefficient of resistance (TCR). In the present embodiment, the thermistors are constructed by thinly printing a material with a negative temperature coefficient (NTC) on the substrate 1105.

A thermistor arrangement with respect to each heating block will now be described.

As shown in FIG. 3B, the thermistors are arranged at one to three locations in accordance with a location of a heating block. The thermistors that detect a temperature of the heating block HB14 arranged at the longitudinal center of the heater 1100 form a heating element temperature detecting portion at three locations. A control thermistor T11-4 for controlling a heating temperature to a prescribed heating temperature is arranged at approximately a center of the heating block HB14 or, in other words, a position corresponding to a vicinity of the transport reference position X. In addition, monitoring thermistors T11-4E and T12-4E for detecting an excessive temperature rise of the heating block HB14 and providing protection are arranged at ends of the heating block HB14 or, in other words, positions corresponding to far sides from the transport reference position X in a formation range of the heating block HB14. A detailed arrangement of the monitoring thermistors T11-4E and T12-4E will be described later.

The thermistors that detect a temperature of the heating block HB13 on an outer side of the heating block HB14 or, in other words, proximal to a side far from the transport reference position X with respect to the heating block HB14 form a heating element temperature detecting portion at two locations. A control thermistor T11-3C for controlling a heating temperature to a prescribed heating temperature is arranged at a position corresponding to a side close to the transport reference position X in a formation range of the heating block HB13. In addition, a monitoring thermistor T11-3E for detecting an excessive temperature rise of the heating block HB13 and providing protection is arranged at a position corresponding to a side far from the transport reference position X in a formation range of the heating block HB13. A detailed arrangement of the control thermistor T11-3C and the monitoring thermistor T11-3E will be described later.

The thermistors T12-5C and T12-5E which detect a temperature of the heating block HB15 arranged at an axisymmetric position to the heating block HB13 with respect to the transport reference position X are respectively arranged at axisymmetric positions to the thermistors T11-3C and T11-3E with respect to the transport reference position X.

The thermistors that detect a temperature of the heating block HB12 on an outer side of the heating block HB13 or, in other words, proximal to a side far from the transport reference position X with respect to the heating block HB13 form a heating element temperature detecting portion at two locations. A control thermistor T11-2C for controlling a heating temperature to a prescribed heating temperature is arranged at a position corresponding to a side close to the transport reference position X in a formation range of the heating block HB12. In addition, a monitoring thermistor T11-2E for detecting an excessive temperature rise of the heating block HB12 and providing protection is arranged at a position corresponding to a side far from the transport reference position X in a formation range of the heating block HB12. A detailed arrangement of the control thermistor T11-2C and the monitoring thermistor T11-2E will be described later.

The thermistors T12-6C and T12-6E which detect a temperature of the heating block HB16 arranged at an axisymmetric position to the heating block HB12 with respect to the transport reference position X are respectively arranged at axisymmetric positions to the thermistors T11-2C and T11-2E with respect to the transport reference position X.

The thermistor that detects a temperature of the heating block HB11 on an outer side of the heating block HB12 or, in other words, proximal to a side far from the transport reference position X with respect to the heating block HB12 forms a heating element temperature detecting portion at one location. A control thermistor T11-1C for controlling a heating temperature to a prescribed heating temperature is arranged inside a formation range of HB11. A detailed arrangement of the control thermistor T11-1C will be described later.

The thermistor T12-7C which detects a temperature of the heating block HB17 arranged at an axisymmetric position to the heating block HB11 with respect to the transport reference position X is arranged at an axisymmetric position to the thermistor T11-1C with respect to the transport reference position X.

The thermistors described above are respectively configured so as to be capable of temperature detection due to conductive patterns for resistance value detection (for example, in the case of the heating block HB13, a conductive pattern ET11-3C, a conductive pattern ET11-3E, and a common conductive pattern EG11).

The insulating (in the present embodiment, glass) surface protection layer 1108 is formed on a surface (a sliding surface layer 2) of the substrate 1105 on a side of the fixing nip portion N in order to ensure slidability of the film 202. The surface protection layer 1108 covers the main thermistors, the conductive patterns, and the common conductive pattern. However, in order to ensure connection with the electrical contacts, a part of the conductive patterns and a part of the common conductive pattern are exposed at both ends of the heater 1100 as shown in FIG. 3B.

Next, a detailed arrangement of thermistors across a boundary between heating blocks that are proximal in the heater longitudinal direction will be described.

Figure 4:
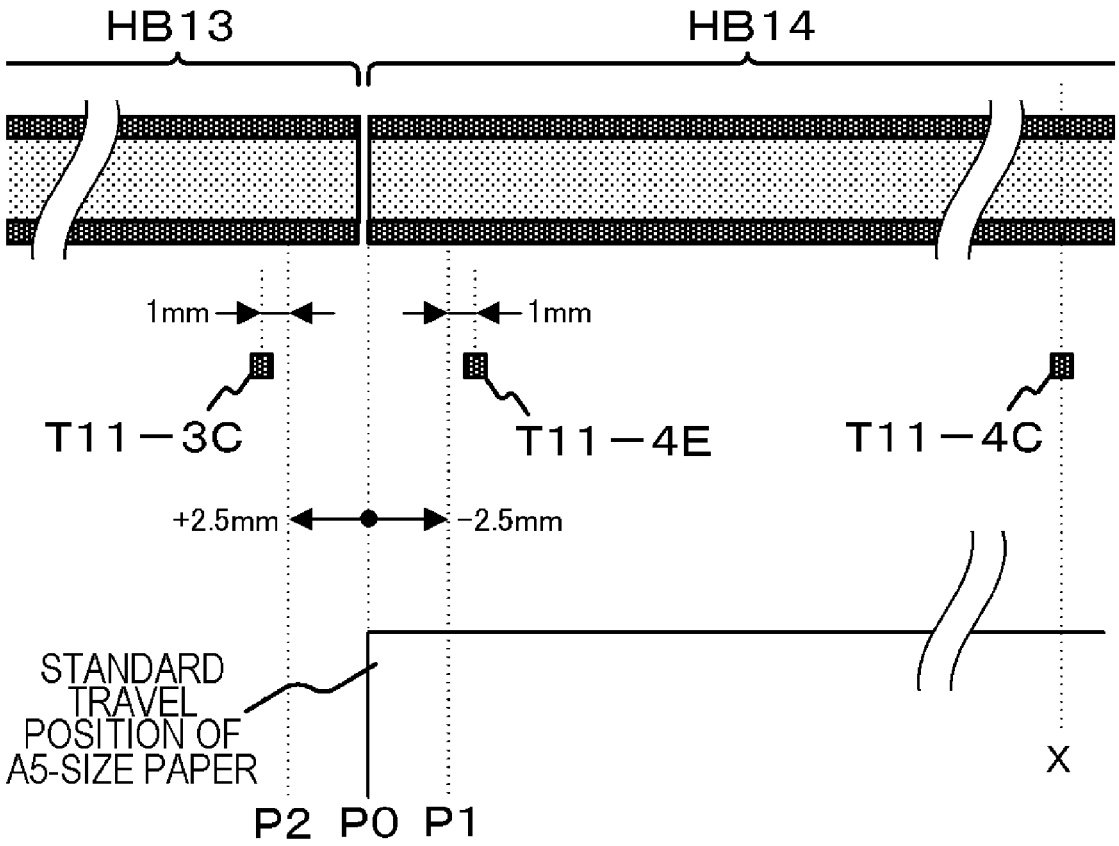
FIG. 4 is a thermistor arrangement diagram according to the first embodiment.

FIG. 4 is a diagram showing a detailed arrangement of thermistors with respect to a standard travel position of a standard size. As a representative example, an arrangement of the heating block HB14, the monitoring thermistor T11-4E, the heating block HB13, and the control thermistor T11-3C with respect to a standard travel position during longitudinal transport of a sheet of A5-size paper that is a standard size will be described.

In this case, the heating block HB14 corresponds to a first heating element on a side close to the transport reference position X. In addition, the monitoring thermistor T11-4E corresponds to a temperature detecting member on a side far from the transport reference position X among the thermistors T11-4C, T11-4E, and T12-4E as first heating element temperature detecting portions that detect a temperature (of a heated region that is heated by) the heating block HB14. Furthermore, the heating block HB13 corresponds to a second heating element proximal (adjacent) to a side far from the transport reference position X with respect to the heating block HB14 as the first heating element. Moreover, the monitoring thermistor T11-3C corresponds to a temperature detecting member on a side close to the transport reference position X among the thermistors T11-3C and T11-3E as second heating element temperature detecting portions that detect a temperature (of a heated region that is heated by) the heating block HB13 as the second heating element.

As the first temperature detecting member, the monitoring thermistor T11-4E of the heating block HB14 is arranged at an end on a side where the heating block HB13 is arranged with respect to the transport reference position X among paper width direction ends during longitudinal transport of a sheet of A5-size paper. More specifically, the monitoring thermistor T11-4E is arranged in a vicinity of a side much closer to the transport reference position X from a position P1 representing a movement of 2.5 mm toward a side close to the transport reference position X with respect to a standard travel position P0 of the paper width direction end. The monitoring thermistor T11-4E is desirably arranged within a distance of 3 mm from P1 and, in the case of the present embodiment, the monitoring thermistor T11-4E is arranged at a position representing a movement of 1 mm toward a side close to the transport reference position X with respect to P1.

As the second temperature detecting member, the control thermistor T11-3C of the heating block HB13 is arranged in a vicinity of a side much farther from the transport reference position X from a position P2 representing a movement of 2.5 mm toward a side far from the transport reference position X with respect to the standard travel position P0. The control thermistor T11-3C is desirably arranged within a distance of 3 mm from P2 and, in the case of the present embodiment, the control thermistor T11-3C is arranged at a position representing a movement of 1 mm toward a side far from the transport reference position X with respect to P2.

In this case, the ranges of P1 and P2 described above represent ±2.5 mm as an allowable shift range of the travel position with respect to the standard travel position P0 of the width direction end of a sheet of A5-size paper. In other words, when transporting a sheet of A5-size paper, the monitoring thermistor T11-4E of the heating block HB14 is always arranged within a paper-passing region of A5-size paper with respect to the paper width direction even when taking a shift in the travel position into consideration. In addition, the control thermistor T11-3C of the heating block HB13 is always arranged within a non-paper-passing region of A5-size paper with respect to the paper width direction even when taking a travel position shift of A5-size paper into consideration.

The monitoring thermistor T12-4E and the control thermistor T12-5C of the heating block HB15 which are arranged at axisymmetric positions to the monitoring thermistor T11-4E with respect to the transport reference position X are also arranged in a similar positional relationship to that described above.

In addition, other thermistors across a boundary between proximal heating blocks are also arranged in a similar positional relationship to that described above.

In a combination of the heating block HB13, the monitoring thermistor T11-3E, the heating block HB12, and the control thermistor T11-2C, the thermistors T11-3E and T11-2C are arranged in a similar positional relationship to that described above with respect to a standard travel position of an end in the paper width direction of a sheet of B5-size paper. In other words, the heating block HB13 corresponds to the first heating element and the monitoring thermistor T11-3E corresponds to the temperature detecting member of the first heating element temperature detecting portion. In addition, the heating block HB12 corresponds to the second heating element that is proximal to the heating block HB13 as the first heating element, and the control thermistor T11-2C corresponds to the temperature detecting member of the second heating element temperature detecting portion.

The monitoring thermistor T12-5E and the control thermistor T12-6C of the heating block HB16 which are arranged at axisymmetric positions to the monitoring thermistor T11-3E with respect to the transport reference position X are also arranged in a similar positional relationship to that described above.

In a combination of the heating block HB12, the monitoring thermistor T11-2E, the heating block HB11, and the control thermistor T11-1C, the thermistors T11-2E and T11-1C are arranged in a similar positional relationship to that described above with respect to a standard travel position of an end in the paper width direction of a sheet of A4-size paper.

In other words, the heating block HB12 corresponds to the first heating element and the monitoring thermistor T11-2E corresponds to the temperature detecting member of the first heating element temperature detecting portion. In addition, the heating block HB11 corresponds to the second heating element that is proximal to the heating block HB12 as the first heating element, and the control thermistor T11-1C corresponds to the temperature detecting member of the second heating element temperature detecting portion.

The monitoring thermistor T12-6E and the control thermistor T12-7C of the heating block HB17 which are arranged at axisymmetric positions to the monitoring thermistor T11-2E with respect to the transport reference position X are also arranged in a similar positional relationship to that described above.

Figure 5:
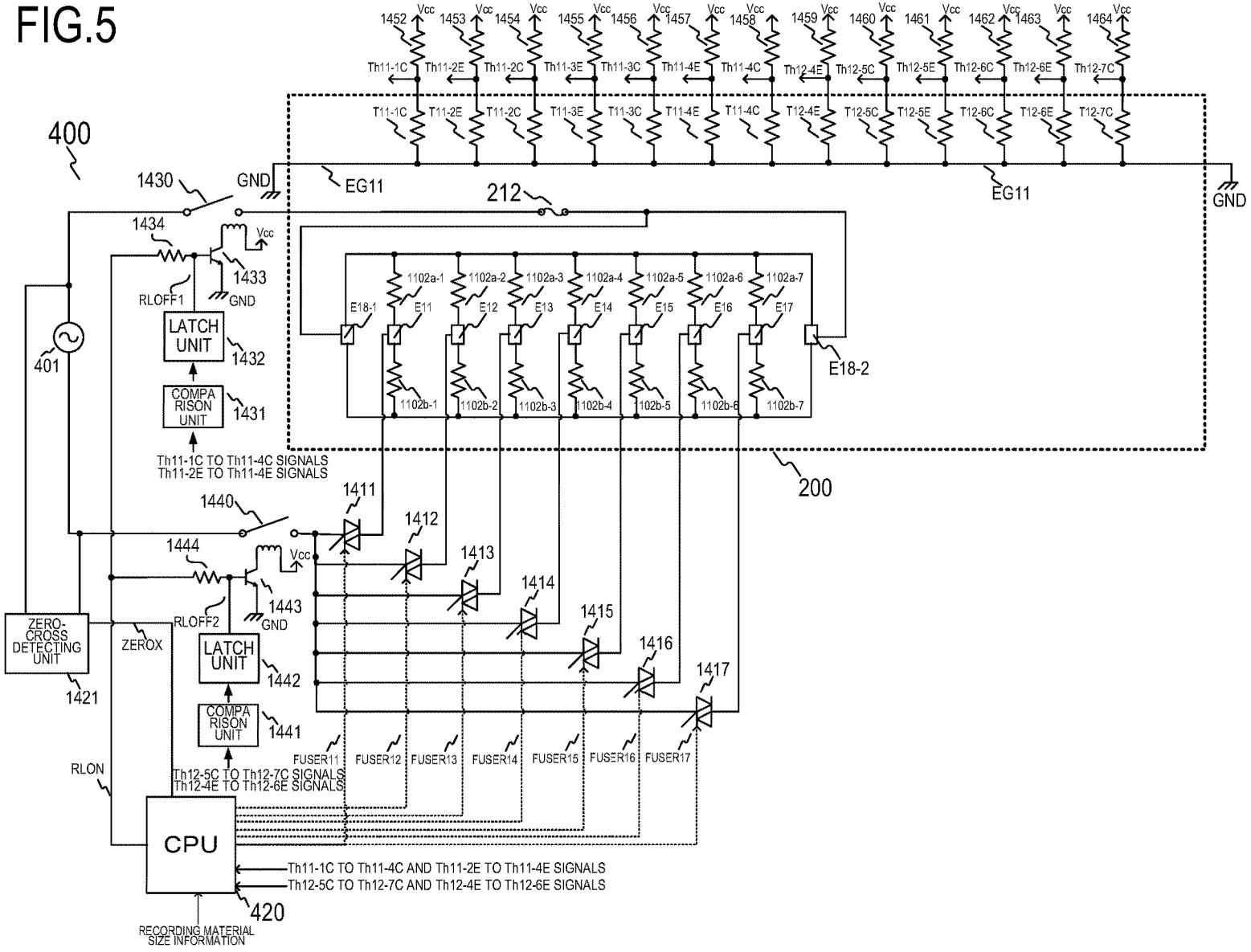
FIG. 5 is a heater control circuit diagram according to the first embodiment.

FIG. 5 is a circuit diagram of the control circuit 400 which is control means of the heater 1100. The laser printer 100 receives supply of power from the commercial AC power supply 401 connected thereto. Power control of the heater 1100 is performed by energizing/interrupting energization of triacs 1411 to 1417. The triacs 1411 to 1417 respectively operate in accordance with signals FUSER11 to FUSER17 from a CPU 420. The control circuit 400 of the heater 1100 has a circuit configuration which enables the seven heating blocks HB11 to HB17 to be independently controlled using the seven triacs 1411 to 1417. It should be noted that driving circuits of the triacs 1411 to 1417 have been omitted in FIG. 5.

A zero-cross detecting unit 1421 is a circuit which detects a zero cross of the AC power supply 401 and which outputs a ZEROX signal to the CPU 420. The ZEROX signal is used as a reference signal for performing phase control of the triacs 1411 to 1417 and the like.

Next, a temperature detecting method of the heater 1100 will be described. The CPU 420 receives input of signals obtained by dividing a voltage Vcc by resistance values of the thermistors T11-1C to T11-4C, T11-2E to T11-4E, T12-5C to T12-7C, and T12-4E to T12-6E and resistance values of resistors 1452 to 1464. In other words, signals Th11-1C to Th11-4C, Th11-2E to Th11-4E, Th12-5C to Th12-7C, and Th12-4E to Th12-6E are input to the CPU 420.

For example, the signal Th11-4C is a signal obtained by dividing the voltage Vcc by the resistance value of the thermistor T11-4C and the resistance value of the resistor 1458. Since the thermistor T11-4C assumes a resistance value in accordance with the temperature, when the temperature of the heating block HB14 changes, a level of the signal Th11-4C input to the CPU 420 also changes. The CPU 420 converts each input signal to a temperature in accordance with a level thereof.

The CPU 420 calculates supply power by, for example, PI control based on a set temperature (a control target temperature) of each heating block and a detected temperature of each thermistor. Furthermore, the CPU 420 converts the calculated supply power into control timings of a corresponding phase angle (phase control), wave number (wave number control), and the like, and controls the triacs 1411 to 1417 at these control timings.

Since signals corresponding to the other thermistors are processed in a similar manner, a description thereof will be omitted.

Next, power control to the heater 1100 (heater temperature control) will be described. During a fixing process, each of the heating blocks HB11 to HB17 is controlled by the CPU 420 so that a detected temperature of the control thermistors T11-1C to T11-4C and T12-5C to T12-7C of each heating block is maintained at a prescribed temperature (a control target temperature). For example, power supplied to the heating block HB14 is controlled by controlling drive of the triac 1414 so that the detected temperature of the thermistor T11-4C is maintained at the prescribed temperature. The prescribed temperature is set to a prescribed paper-passing portion temperature when it is determined that each control thermistor is within a range included in a paper-passing portion on the basis of width information of the recording material P but set to a prescribed non-paper-passing portion temperature when it is determined that each control thermistor is within a range included in a non-paper-passing portion. In the present embodiment, the paper-passing portion temperature is set to 200° C. to 230° C. in accordance with a type of recording material, atmospheric environment, and print mode, and the non-paper-passing portion temperature is set to 180° C. to 230° C. which is equal to or lower than the paper-passing portion temperature.

Width information of a recording material can be acquired by various conventionally known methods. For example, a width of a recording material can be determined by a method of providing a paper feeding cassette and a paper feeding tray with a paper width sensor, a method of using a sensor such as a flag (not illustrated) provided on a recording material transport path, or a method on the basis of width information of the recording material set by a user.

When the detected temperature of any of the monitoring thermistors T11-2E to T11-4E and T12-4E to T12-6E of each heating block exceeds a prescribed high-temperature threshold, an operation for protecting each heating block from an excessive temperature rise is executed by the CPU 420. For example, control for extending paper feeding intervals of the recording material P or control for suppressing energization to each heating block is executed. The high-temperature threshold is set to a temperature that is higher than the fixing temperature described above and, in the present embodiment, the prescribed high-temperature threshold is set to 260° C.

A relay 1430 and a relay 1440 are mounted as means which interrupt power to the heater 1100 when the temperature of the heater 1100 rises excessively due to an apparatus failure or the like. Next, circuit operations of the relay 1430 and the relay 1440 will be described.

When a RLON signal output from the CPU 420 assumes a High state, a transistor 1433 is switched to an ON state, a secondary-side coil of the relay 1430 is energized from a DC power supply (voltage Vcc), and a primary-side contact of the relay 1430 is switched to an ON state. When the RLON signal assumes a Low state, the transistor 1433 is switched to an OFF state, a current flowing from the power supply (voltage Vcc) to the secondary-side coil of the relay 1430 is interrupted, and the primary-side contact of the relay 1430 is switched to an OFF state. In a similar manner, when the RLON signal assumes a High state, a transistor 1443 is switched to an ON state, a secondary-side coil of the relay 1440 is energized by the power supply (voltage Vcc), and a primary-side contact of the relay 1440 is switched to an ON state. When the RLON signal assumes a Low state, the transistor 1443 is switched to an OFF state, a current flowing from the power supply (voltage Vcc) to the secondary-side coil of the relay 1440 is interrupted, and the primary-side contact of the relay 1440 is switched to an OFF state.

Next, operations of a protection circuit (a hard circuit that does not involve the CPU 420) using the relay 1430 and the relay 1440 will be described. When a level of any of the signals Th11-1C to Th11-4C and Th11-2E to Th11-4E exceeds a prescribed value internally set to a comparison portion 1431, the comparison portion 1431 operates a latch unit 1432. The latch unit 1432 latches a RLOFF1 signal in a Low state. When the RLOFF1 signal assumes the Low state, since the transistor 1433 is kept in an OFF state even when the CPU 420 changes the RLON signal to a High state, the relay 1430 can be kept in an OFF state (a safe state). Moreover, in a non-latched state, the latch unit 1432 sets the RLOFF1 signal to open-state output.

In a similar manner, when a level of any of the signals Th12-4C to Th12-7C and Th12-4E to Th12-6E exceeds a prescribed value internally set to a comparison unit 1441, the comparison unit 1441 operates a latch unit 1442. The latch unit 1442 latches a RLOFF2 signal in a Low state. When the RLOFF2 signal assumes the Low state, since the transistor 1443 is kept in an OFF state even when the CPU 420 changes the RLON signal to a High state, the relay 1440 can be kept in an OFF state (a safe state). In a non-latched state, the latch unit 1442 sets the RLOFF2 signal to open-state output. The prescribed value that is internally set to the comparison unit 1431 and the prescribed value that is internally set to the comparison unit 1441 according to the present embodiment are both values corresponding to 300° C. It should be noted that a resistor 1434 and a resistor 1444 are current-limiting resistors.

Figure 6A:
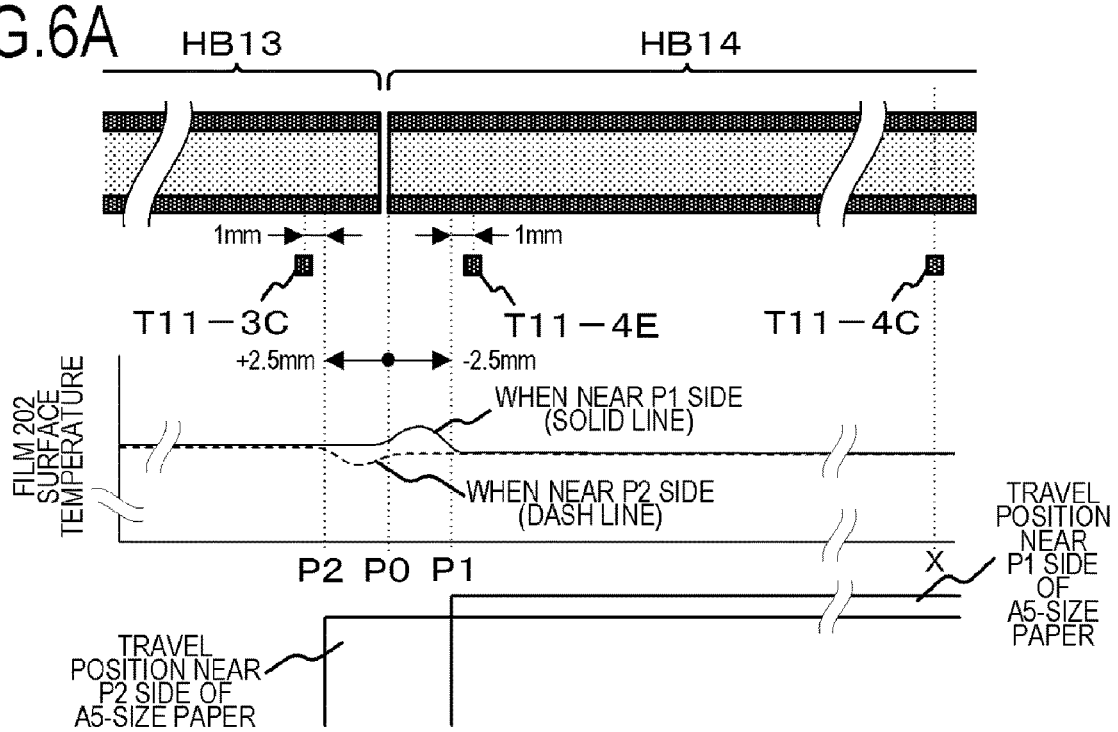
FIGS. 6A and 6B are film temperature distribution diagrams according to the first embodiment.

FIG. 6A shows a longitudinal temperature distribution on a surface of the film 202 near the heating block HB13 and the heating block HB14 when sheets of A5-size paper are continuously transported. Power to the heating block HB14 is controlled so that the control thermistor T11-4C is maintained at the paper-passing portion temperature, and power to the heating block HB13 is controlled so that the control thermistor T11-3C is maintained at the non-paper-passing portion temperature. In this case, since the sheets of A5-size paper travel within a shift range of ±2.5 mm which is within an allowable range with respect to a standard travel position, the monitoring thermistor T11-4E of the heating block HB14 is always included in a paper-passing portion. On the other hand, the control thermistor T11-3C of the heating block HB13 is always included in a non-paper-passing portion.

In FIG. 6A, a solid line indicates a film temperature distribution in a case (the P1 position) where a travel position of an end in the paper width direction of a sheet of A5-size paper near a boundary between the heating block HB13 and the heating block HB14 makes a closest approach to the transport reference position X with respect to a standard travel position P0. Since a part of the heating block HB14 juts out from a paper-passing portion and constitutes a non-paper-passing portion, although a temperature of the portion becomes higher than that of the paper-passing portion, protection from an excessive temperature rise need not be provided even when the end in the paper width direction travels the P1 position that represents a jut amount of the heating block HB14 of 2.5 mm.

In addition, in FIG. 6A, a dash line indicates a film temperature distribution in a case (the P2 position) where the travel position of the end in the paper width direction of a sheet of A5-size paper near a boundary between the heating block HB13 and the heating block HB14 is most distanced from the transport reference position X with respect to the standard travel position P0. Since a part of the heating block HB13 penetrates into the paper-passing portion, although a temperature of the portion becomes lower than that of the paper-passing portion with which the heating block HB14 overlaps, faulty fixing does not occur even when the end in the paper width direction travels the P2 position that represents a penetration amount of the heating block HB13 of 2.5 mm.

Figure 6B:
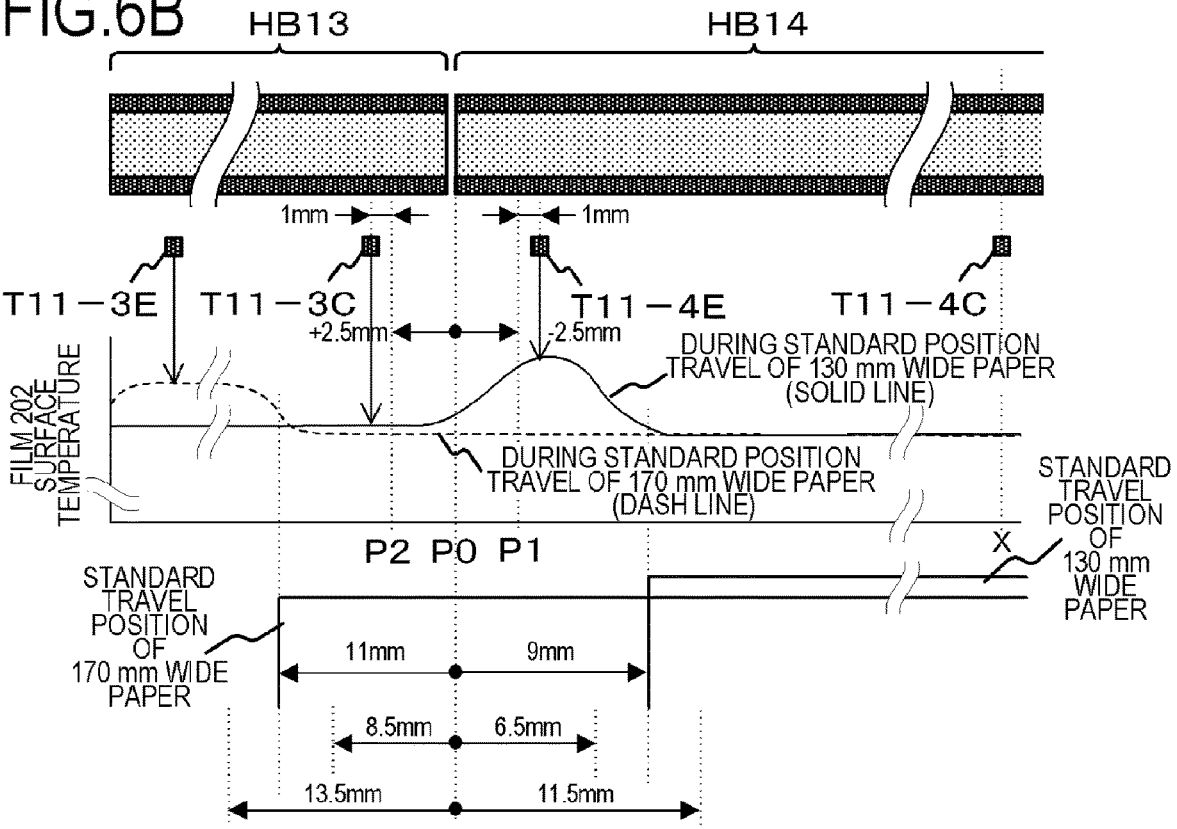

FIG. 6B shows a longitudinal temperature distribution (solid line) on the surface of the film 202 near the heating block HB13 and the heating block HB14 when sheets of 130 mm-wide paper as a non-standard size are continuously transported. In a similar manner to that described above, power to the heating block HB14 is controlled so that the control thermistor T11-4C is maintained at the paper-passing portion temperature, and power to the heating block HB13 is controlled so that the control thermistor T11-3C is maintained at the non-paper-passing portion temperature. When sheets of 130 mm-wide paper are continuously transported, a part of the heating block HB14 juts out from a paper-passing portion and constitutes a non-paper-passing portion and a jut amount in a case of a standard travel position is 9 mm. Considering the fact that travel takes place within a range of ±2.5 mm, the jut amount is within a range of 6.5 mm to 11.5 mm. In this case, although protection from an excessive temperature rise must be provided, since the monitoring thermistor T11-4E according to the present embodiment is arranged in the non-paper-passing portion with respect to continuous transport of sheets of this paper, protection from an excessive temperature rise can be provided by monitoring a non-paper-passing portion temperature rise and detecting the high-temperature threshold described earlier. In this manner, even when the end in the paper width direction exceeds the P1 position that is an allowable range of A5 size and approaches the transport reference position X, a non-paper-passing portion temperature rise can be monitored by the monitoring thermistor T11-4E and protection from an excessive temperature rise can be provided.

FIG. 6B also shows a longitudinal temperature distribution (dash line) on the surface of the film 202 near the heating block HB13 and the heating block HB14 when sheets of 170 mm-wide paper as a non-standard size are continuously transported. When sheets of 170 mm-wide paper are continuously transported, a part of the heating block HB13 penetrates into a paper-passing portion and a jut amount in a case of a standard travel position is 11 mm (considering the fact that travel takes place within a range of ±2.5 mm, a penetration amount is within a range of 8.5 mm to 13.5 mm). The control thermistor T11-3C of the heating block HB13 according to the present embodiment is arranged in a paper-passing portion with respect to continuous transport of sheets of 170 mm-wide paper, and power to the heating block HB13 is controlled so that the control thermistor T11-3C is maintained at the paper-passing portion temperature. Therefore, since a temperature of a penetrating portion of the heating block HB13 never falls below the paper-passing portion with which the heating block HB14 overlaps, faulty fixing can be prevented. In this manner, even when the end in the paper width direction exceeds the P2 position that is an allowable range of A5 size and separates from the transport reference position X, an amount of heat generation is controlled by the control thermistor T11-3C so as to maintain a prescribed temperature and faulty fixing is prevented. In addition, at the same time, a non-paper-passing portion temperature rise of the heating block HB13 can be monitored by the monitoring thermistor T11-3E and protection from an excessive temperature rise can be provided.

According to the present embodiment, in a heater including plurally-divided heating blocks, appropriately arranging temperature detecting portions enables temperature control of the heating blocks to be stabilized with respect to a travel position shift of standard-size recording materials. In addition, control for preventing faulty fixing and excessive temperature rises can be applied to non-standard-size recording materials.

While FIG. 6B shows paper sizes that do not cause, during continuous transport, the monitoring thermistor T11-4E to overlap with a paper-passing portion or the control thermistor T11-3C to overlap with a non-paper-passing portion as examples of non-standard size paper, the present embodiment is not limited thereto. The present embodiment is also valid in cases of continuously transporting non-standard size paper of sizes in which a variation in travel position causes the monitoring thermistor T11-4E to overlap with a paper-passing portion or the control thermistor T11-3C to overlap with a non-paper-passing portion. In other words, with the arrangement of thermistors according to the present embodiment, since the monitoring thermistor T11-4E is arranged at a position of the heating block HB14 which requires protection from an excessive temperature rise, the heating block HB14 can be protected from an excessive temperature rise in accordance with a detected temperature state. In addition, since the control thermistor T11-3C is arranged at a position of the heating block HB13 where faulty fixing needs to be dealt with, faulty fixing can be prevented by controlling power so that a paper-passing portion temperature is maintained.

Furthermore, FIGS. 6A and 6B illustrate an example of transporting A5 paper as a standard size and non-standard size paper with a width similar to that of A5 paper with respect to an arrangement of thermistors near a boundary between the heating block HB14 and the heating block HB13 proximal thereto, the present embodiment is not limited thereto. A similar description can be applied to transporting B5 paper with respect to an arrangement of thermistors near a boundary between the heating block HB13 and the heating block HB12 proximal thereto and to transporting A4 paper with respect to an arrangement of thermistors near a boundary between the heating block HB12 and the heating block HB11 proximal thereto. In addition, a similar description can be applied to a proximal heating block arranged at an axisymmetric position to the proximal heating block described above with respect to the transport reference position X.

First Comparative Example

Next, a case where a heater 1200 according to a first comparative example is used will be described.

Figure 7A:
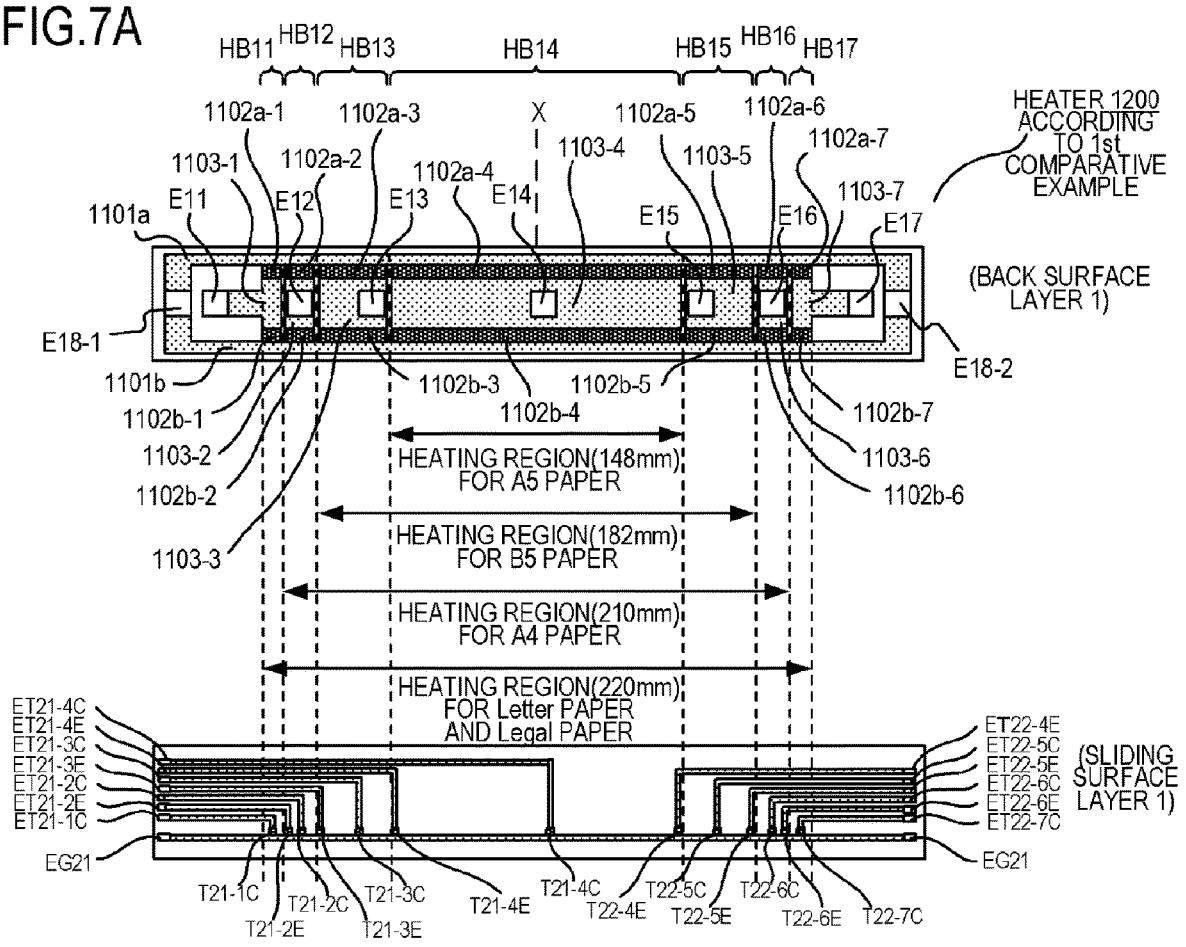
FIGS. 7A and 7B are diagrams showing a heater configuration and a thermistor arrangement according to a first comparative example.

FIG. 7A shows a part of a configuration diagram of the heater 1200 according to the first comparative example. The heater 1200 shares a same configuration as the heater 1100 according to the first embodiment with the exception of having a different arrangement of thermistors on the sliding surface layer 1, and the same components as those of the first embodiment are denoted by the same symbols and descriptions thereof are omitted.

As shown in FIG. 7A, control thermistors T21-1C to T21-4C and T22-5C to T22-7C for controlling each of the heating blocks HB11 to HB17 of the heater 1200 to prescribed heating temperatures are arranged approximately near a center in the longitudinal direction of each heating block. In addition, monitoring thermistors T21-2E to T21-4E and T22-4E to T22-6E for protecting each of the heating blocks HB11 to HB17 from an excessive temperature rise are arranged in each heating block near a boundary with a heating block proximal to a side far from the transport reference position X.

Figure 7B:
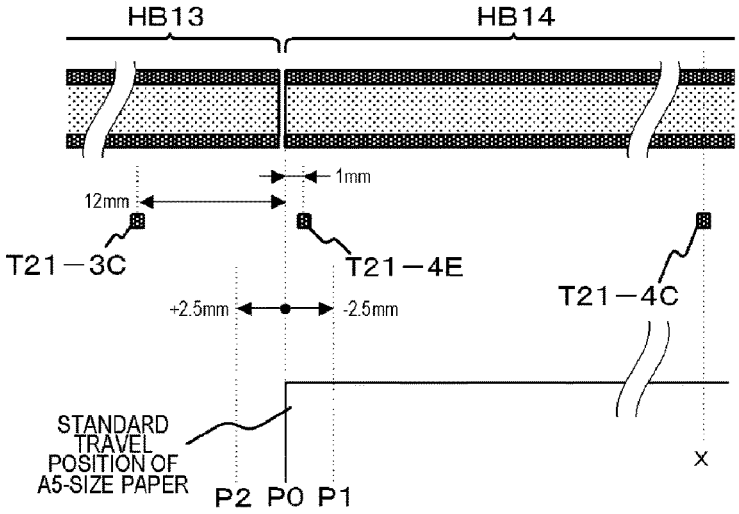

FIG. 7B is a diagram showing a detailed arrangement of the monitoring thermistor T21-4E of the heating block HB14 and the control thermistor T21-3C of the heating block HB13 as a representative example. The monitoring thermistor T21-4E is arranged in the longitudinal direction at a position brought nearer to the transport reference position X by 1 mm with respect to a paper width direction end P0 in the standard travel position of a sheet of A5-size paper and is included in a range of travel position variation of A5 size. The control thermistor T21-3C is arranged approximately at center in the longitudinal direction of the heating block HB13 and is separated from the paper width direction end P0 in the standard travel position of a sheet of A5-size paper by 12 mm.

Figure 8:
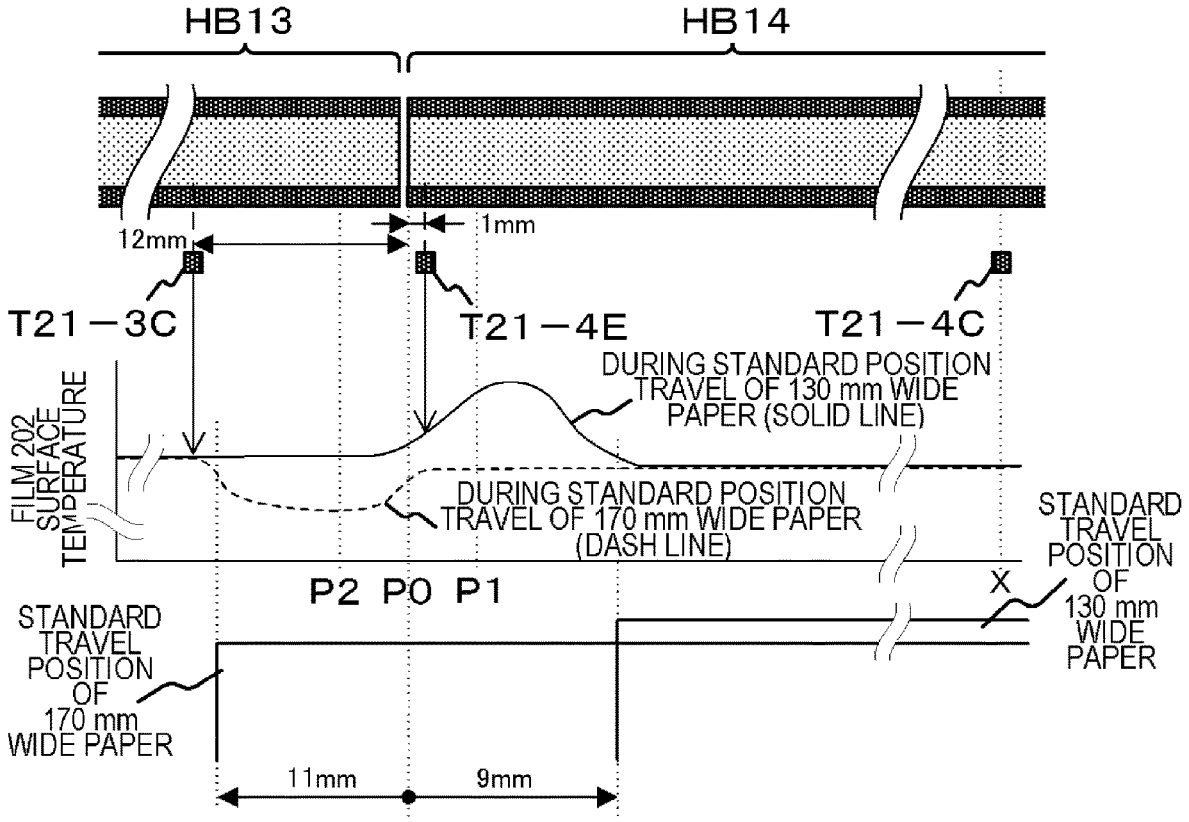
FIG. 8 is a film temperature distribution diagram according to the first comparative example.

FIG. 8 shows, indicated by a solid line, a longitudinal temperature distribution on the surface of the film 202 near the heating block HB13 and the heating block HB14 when sheets of 130 mm-wide paper as a non-standard size are continuously transported with respect to a fixing apparatus using the heater 1200. Power to the heating block HB14 is controlled so that the control thermistor T21-4C is maintained at the paper-passing portion temperature, and power to the heating block HB13 is controlled so that the control thermistor T21-3C is maintained at the non-paper-passing portion temperature. A part of the heating block HB14 juts out from a paper-passing portion and constitutes a non-paper-passing portion and a jut amount in a case of a standard travel position is 9 mm. In this case, although protection from an excessive temperature rise must be provided, the monitoring thermistor T21-4E according to the first comparative example is arranged at an end on a side close to the heating block HB13 among the ends of the heating block HB14. Therefore, since heat of a non-paper-passing portion temperature rise due to jutting of the heating block HB14 with respect to continuous transport of sheets of 130 mm-wide paper is dissipated to a side of the heating block HB13, it is difficult to accurately monitor a peak temperature of the non-paper-passing portion temperature rise. In this case, since the peak of the non-paper-passing portion temperature rise must be predicted on the basis of paper width information and the like, it is difficult to provide appropriate protection from an excessive temperature rise.

FIG. 8 shows, indicated by a dash line, a longitudinal temperature distribution on the surface of the film 202 near the heating block HB13 and the heating block HB14 when sheets of 170 mm-wide paper as a non-standard size are continuously transported. When sheets of 170 mm-wide paper are continuously transported, a part of the heating block HB13 penetrates into a paper-passing portion and a jut amount in a case of a standard travel position is 11 mm. The control thermistor T21-3C of the heating block HB13 according to the first comparative example is arranged in a non-paper-passing portion (when taking a variation in the travel position into consideration, a position causing the control thermistor T21-3C to overlap with the paper-passing portion or to overlap with the non-paper-passing portion) with respect to a standard travel position of 170 mm-wide paper. Therefore, it is difficult to control power to the heating block HB13 in a stable manner and penetration of the heating block HB13 into a paper-passing portion may possibly cause the temperature to drop significantly with respect to the paper-passing portion with which the heating block HB14 overlaps. In this case, since the temperature drop must be predicted on the basis of paper width information and the like, it is difficult to appropriately prevent faulty fixing.

While FIG. 8 illustrates an example of transporting non-standard size paper with a width similar to that of A5 paper as a standard size with respect to an arrangement of thermistors near a boundary between the heating block HB14 and the heating block HB13 proximal thereto, a similar description also applies to other proximal heating blocks. When a monitoring thermistor is too near to a boundary between heating blocks or a control thermistor is too far from a boundary between heating blocks, it may be difficult to appropriately deal with an excessive temperature rise or faulty fixing.

Second Comparative Example

Next, a case where a heater 1300 according to a second comparative example is used will be described.

Figure 9A:
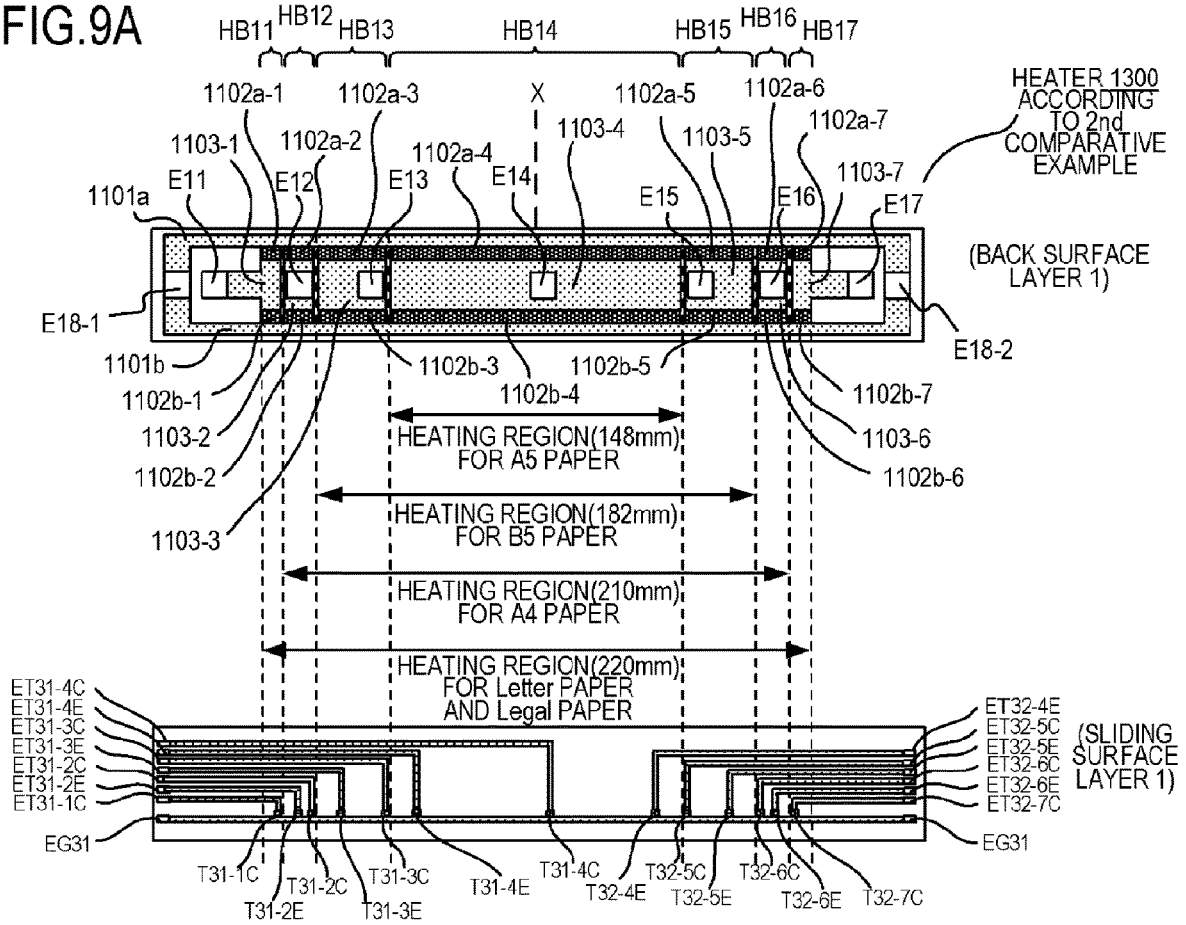
FIGS. 9A and 9B are diagrams showing a heater configuration and a thermistor arrangement according to a second comparative example.

FIG. 9A shows a configuration diagram of the heater 1300 according to the second comparative example. The heater 1300 shares a same configuration as the heater 1100 according to the first embodiment with the exception of having a different arrangement of thermistors on the sliding surface layer 1, and the same components as those of the first embodiment are denoted by the same symbols and descriptions thereof are omitted.

As shown in FIG. 9A, control thermistors T31-1C to T31-4C and T32-5C to T32-7C for temperature adjustment control of each of the heating blocks HB11 to HB17 are arranged in each heating block near a boundary with a heating block proximal to a side close to the transport reference position X. In addition, monitoring thermistors T31-2E to T31-4E and T32-4E to T32-6E for excessive temperature rise protection of each of the heating blocks HB11 to HB17 are arranged at a position significantly nearer toward the transport reference position X from a paper width direction end at a standard travel position of a standard size.

Figure 9B:
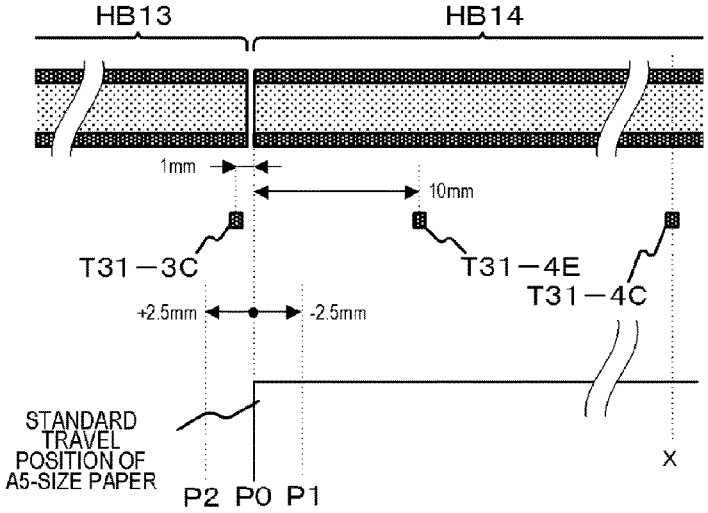

FIG. 9B is a diagram showing a detailed arrangement of the monitoring thermistor T31-4E of the heating block HB14 and the control thermistor T31-3C of the heating block HB13 as a representative example. The monitoring thermistor T31-4E is arranged at a position moved toward a side close to the transport reference position X by 10 mm from a paper width direction end P0 in the standard travel position of a sheet of A5-size paper. The control thermistor T31-3C is arranged at a position moved 1 mm to a side far from the transport reference position X with respect to the paper width direction end P0 in the standard travel position of a sheet of A5-size paper and is included in a range of travel position variation of A5-size paper.

Figure 10:
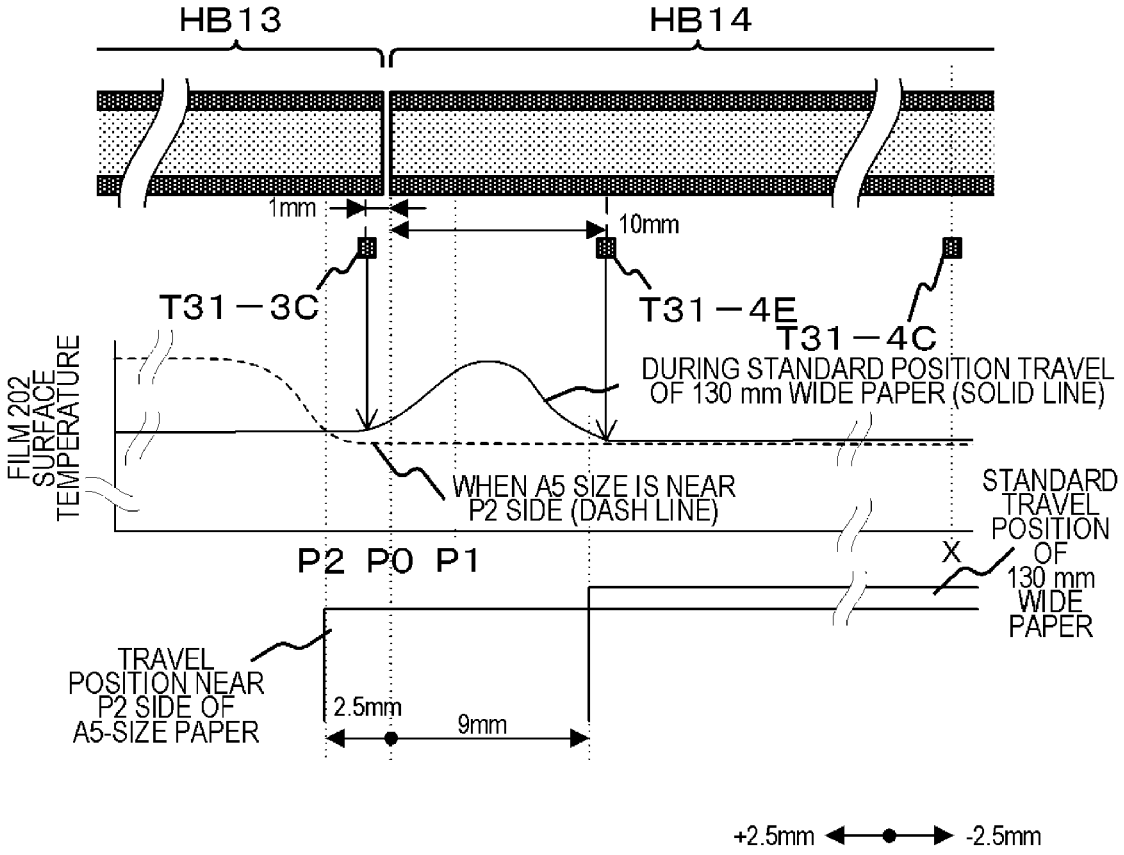
FIG. 10 is a film temperature distribution diagram according to the second comparative example.

FIG. 10 shows a longitudinal temperature distribution (solid line) on the surface of the film 202 near the heating block HB13 and the heating block HB14 when sheets of 130 mm-wide paper as a non-standard size are continuously transported with respect to a fixing apparatus using the heater 1300. Power to the heating block HB14 is controlled so that the control thermistor T31-4C is maintained at the paper-passing portion temperature, and power to the heating block HB13 is controlled so that the control thermistor T31-3C is maintained at the non-paper-passing portion temperature. A part of the heating block HB14 juts out from a paper-passing portion and constitutes a non-paper-passing portion and a jut amount in a case of a standard travel position is 9 mm. In this case, while protection from an excessive temperature rise must be provided, the monitoring thermistor T31-4E according to the first comparative example is arranged in a paper-passing portion (when taking a variation in the travel position into consideration, a position that causes the monitoring thermistor T31-4E to overlap with the paper-passing portion or to overlap with the non-paper-passing portion) with respect to a standard travel position of 130 mm-wide paper. Therefore, it is difficult to accurately monitor a peak temperature of the non-paper-passing portion temperature rise due to jutting of the heating block HB14. In this case, since the peak of the non-paper-passing portion temperature rise must be predicted on the basis of paper width information and the like, it is difficult to provide appropriate protection from an excessive temperature rise.

In FIG. 10, a dash line indicates a longitudinal temperature distribution on the surface of the film 202 in a case (the P2 position) where the travel position of the paper width direction end of a sheet of A5-size paper near the boundary between the heating block HB13 and the heating block HB14 is most distanced from the transport reference position X with respect to the standard travel position P0. A part of HB13 penetrates into a paper-passing portion and the control thermistor T31-3C of HB13 overlaps with the paper-passing portion. Therefore, while faulty fixing can be prevented by controlling power so that the paper-passing portion temperature is maintained, it is possible that protection from an excessive temperature rise due to a non-paper-passing portion temperature rise of HB13 may be required. Requiring protection from an excessive temperature rise within an allowable range of a travel position of A5-size paper that is a standard size is not preferable from the perspective of a configuration for suppressing a non-paper-passing portion temperature rise which is an original concept of a heater divided into a plurality of heating blocks.

While FIG. 10 illustrates an example of transporting A5 paper as a standard size and non-standard size paper with a width similar to that of A5 paper with respect to an arrangement of thermistors near a boundary between the heating block HB14 and the heating block HB13 proximal thereto, a similar description also applies to other proximal heating blocks. When a monitoring thermistor is too far from a boundary between heating blocks or a control thermistor is too near to a boundary between heating blocks, it may be difficult to appropriately deal with an excessive temperature rise of non-standard size paper. In addition, there is a possibility that a non-paper-passing portion temperature rise may occur due to a variation in travel position of standard size paper.

As described above, in the present embodiment, a thermistor provided in correspondence with a first heating element on a side close to a transport reference position X is arranged in the longitudinal direction with respect to a standard travel position (a reference passing position) of a paper width direction end (a recording material end) of a standard size paper as follows. Specifically, a monitoring thermistor on a side far from the transport reference position X is arranged at a position which is (i) in a vicinity of an end adjacent to a second heating element of the first heating element, and (ii) on a side closer to the transport reference position X than a position separated from the reference passing position by at least 2.5 mm toward a side close to the transport reference position X. 2.5 mm is a first distance that represents a limit position on a side close to the transport reference position X in a prescribed allowable shift range from the reference passing position with respect to a position of a recording material end that passes near a boundary between the first heating element and the second heating element. In addition, a thermistor provided in correspondence with the second heating element on a side far from the transport reference position X is arranged as follows. Specifically, a control thermistor on a side close to the transport reference position X is arranged at a position which is (iii) in a vicinity of an end adjacent to the first heating element of the second heating element, and (iv) on a side farther from the transport reference position X than a position separated from the reference passing position by at least 2.5 mm toward a side far from the transport reference position X. 2.5 mm is a second distance that represents a limit position on a side far from the transport reference position X in the prescribed allowable shift range from the reference passing position with respect to a position of the recording material end that passes near a boundary between the first heating element and the second heating element. Furthermore, as the (i) vicinity of an end adjacent to the second heating element of the first heating element, the monitoring thermistor of the first heating element described above is arranged at a position within 3 mm on a side close to the transport reference position X from the position separated by 2.5 mm. Moreover, as the (iii) vicinity of an end adjacent to the first heating element of the second heating element, the control thermistor of the second heating element described above is arranged at a position within 3 mm on a side much farther from the transport reference position X from the position separated by 2.5 mm. It should be noted that, although the specific numerical values such as 2.5 mm and 3 mm are merely examples and may be changed in accordance with apparatus configuration, the numerical values are nevertheless suitably applicable to the use of general image forming apparatuses of various types. Due to the configuration described above, when transporting sheets of standard size paper, the need to provide protection from an excessive temperature rise and to deal with faulty fixing is eliminated even when a variation in travel position is taken into configuration and, when transporting sheets of non-standard size paper, protection from an excessive temperature rise can be provided and faulty fixing can be prevented in an appropriate manner.

Second Embodiment

In a second embodiment of the present invention, an example will be described in which an end on a side far from a transport reference position in a first heating element on a side close to the transport reference position is arranged on a side close to the transport reference position with respect to a standard travel position in a recording material width direction of a standard-size recording material.

Figure 11:
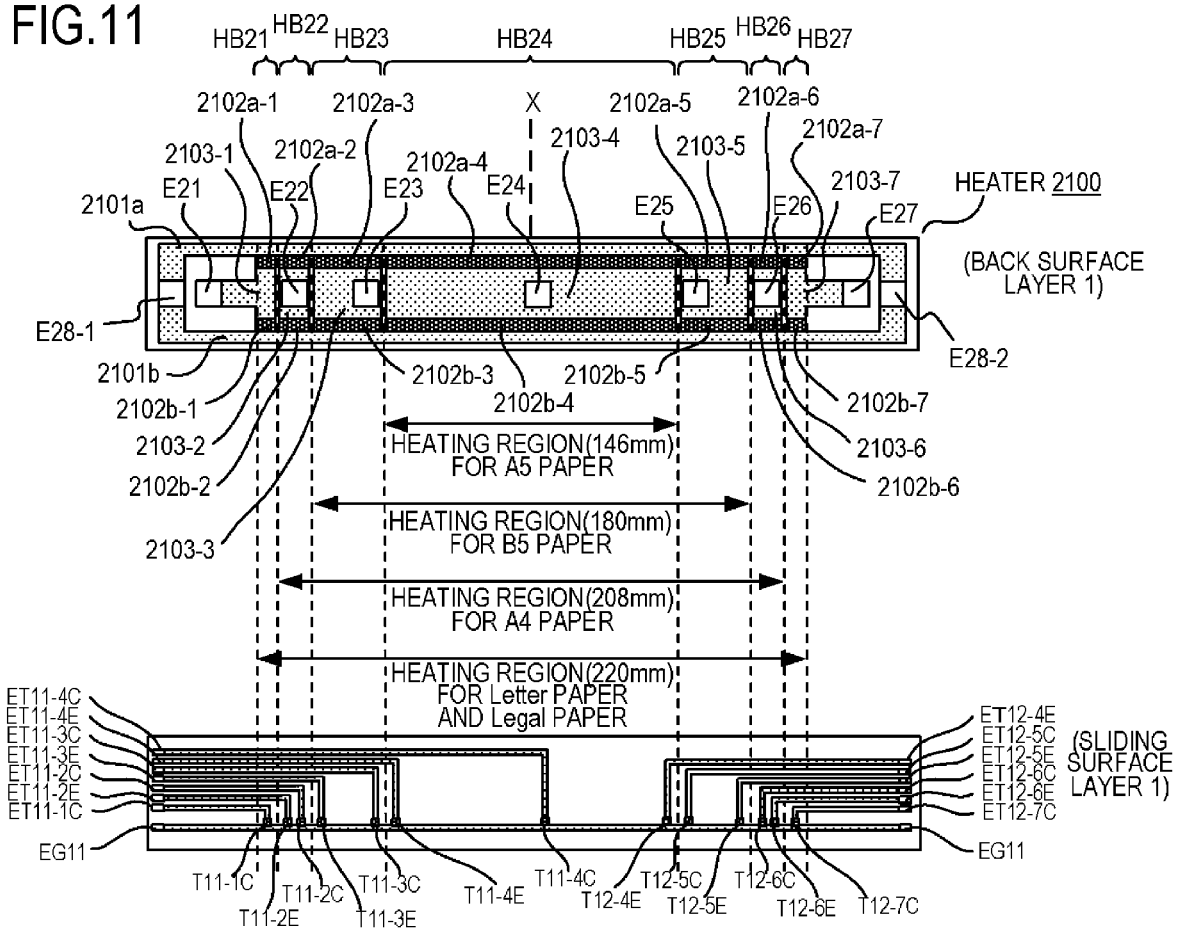
FIG. 11 is a heater configuration diagram according to a second embodiment.

FIG. 11 shows a part of a heater configuration diagram according to the second embodiment. A heater 2100 shares a same configuration as the heater 1100 according to the first embodiment with the exception of having a different arrangement of proximal heating blocks on a back surface layer 1, and the same components as those of the first embodiment are denoted by the same symbols and descriptions thereof are omitted. It is to be understood that matters not particularly described in the second embodiment are similar to those described in the first embodiment.

In FIG. 11, a heating region of a heating block HB24 is set to 146 mm that is shorter than the A5 size (148 mm wide) as a standard size. In addition, a heating region including a heating block HB23 and a heating block HB25 which are arranged on outer sides of the heating block HB24 is set to 180 mm that is shorter than the B5 size (182 mm wide). Furthermore, a heating region including a heating block HB22 and a heating block HB26 which are arranged on further outer sides is set to 208 mm that is shorter than the A4 size (210 mm wide). However, a width of all heating blocks including a heating block HB21 and a heating block HB27 is set to 220 mm that is the same as in the first embodiment.

An arrangement of thermistors on the back surface layer 1 is the same as in the first embodiment. Specifically, each thermistor is arranged in a vicinity of a position separated by ±2.5 mm in the paper width direction (in the case of a + side, a direction of separation from the transport reference position, and in the case of a − side, a direction of approach to the transport reference position) with reference to a standard travel position of a standard size.

Figure 12A:
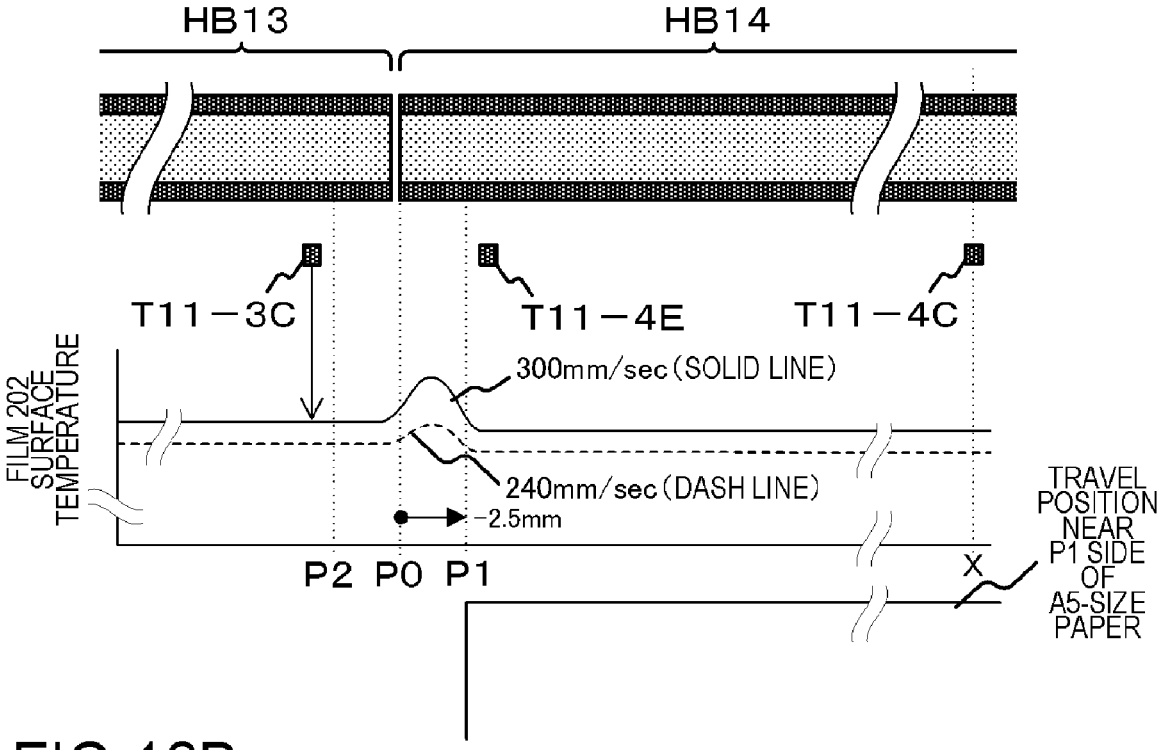
FIGS. 12A and 12B are film temperature distribution diagrams according to the second embodiment.

FIG. 12A shows a film temperature distribution when a transport speed of paper differs in a case (the P1 position) where a travel position of an end in the paper width direction of a sheet of A5-size paper near a boundary between the heating blocks HB13 and HB14 makes a closest approach to the transport reference position X with respect to a travel position P0 in the first embodiment. A specific transport speed is set to 300 mm/sec (solid line) relative to 240 mm/sec (dash line) according to the first embodiment.

As shown in FIG. 12A, in order to heat a sheet of paper to the same degree even when the paper transport speed differs, the higher the transport speed, the higher the temperature to which a film surface of a paper-passing portion must be raised. In addition, since power consumption of the heating block HB14 increases as the paper transport speed increases, a non-paper-passing portion temperature rise increases even at the P1 position where the travel position of the paper width direction end is within an allowable range. Therefore, a jut amount of the heating block HB14 with respect to paper is smaller in the case of 300 mm/sec than in the case of 240 mm/sec and therefore creates a need to provide protection from an excessive temperature rise.

Figure 12B:
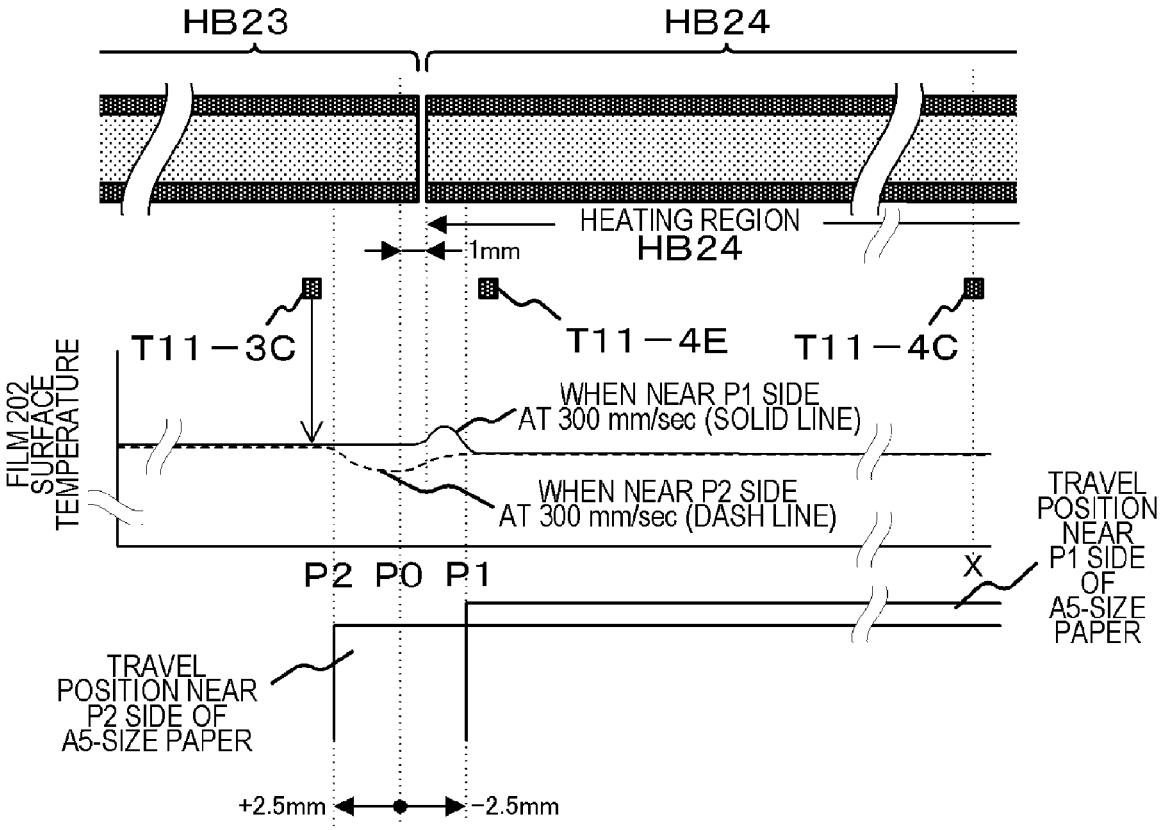

In FIG. 12B, a solid line indicates a film temperature distribution in a case (the P1 position) where a travel position of an end in the paper width direction of a sheet of A5-size paper near a boundary between the heating blocks HB23 and HB24 of the heater 2100 according to the second embodiment approaches the transport reference position X by 2.5 mm with respect to the travel position P0. The paper transport speed in the second embodiment is set to 300 mm/sec that is faster than in the first embodiment. In the heater 2100, the heating region of the heating block HB24 is set to 146 mm that is narrower than 148 mm being the width of A5 size that is a standard size, and a division portion of a heating block is arranged on a transport reference side relative to the standard travel position P0 of a sheet of A5-size paper. In this case, a jut amount of the heating block HB24 to a non-paper-passing portion when the travel position of the paper width direction end of a sheet of A5-size paper is the P1 position is 1.5 mm that is shorter by 1 mm than in the first embodiment. A non-paper-passing portion temperature rise becomes smaller than the non-paper-passing portion temperature rise at 300 mm/sec shown in FIG. 12A. In addition, the monitoring thermistor T11-4E of the heating block HB24 is arranged at a position moved by 1 mm toward a side close to the transport reference position X with respect to the P1 position. Therefore, when the jut amount of the heating block HB24 to the non-paper-passing portion increases due to transport of a non-standard size or the like, since the monitoring thermistor T11-4E overlaps with the non-paper-passing portion, protection from an excessive temperature rise can be provided by monitoring a non-paper-passing portion temperature rise.

In addition, in FIG. 12B, a dash line indicates a film temperature distribution when the transport speed of paper is 300 mm/sec that is faster than in the first embodiment in a case (the P2 position) where the travel position of the end in the paper width direction of a sheet of A5-size paper moves away from the transport reference position X by 2.5 mm with respect to the standard travel position P0. Since the paper transport speed is higher than in the first embodiment, a penetration amount by which a part of the heating block HB23 penetrates into a paper-passing portion is 3.5 mm that is larger than in the first embodiment, and a temperature of the portion is lower than in the first embodiment but nevertheless within an allowable range and faulty fixing does not occur. In addition, the control thermistor T11-3C of the heating block HB23 is arranged at a position moved by 1 mm toward a side far from the transport reference position X with respect to the P2 position. Therefore, when the penetration amount of the heating block HB23 into the paper-passing portion increases due to transport of a non-standard size or the like, the control thermistor T11-3C overlaps with the paper-passing portion. Controlling power of the heating block HB23 so that the control thermistor T11-3C is maintained at the paper-passing portion temperature prevents a temperature of the penetrating portion of the heating block HB23 into a paper-passing portion from dropping with respect to the paper-passing portion with which the heating block HB24 overlaps. Therefore, an occurrence of faulty fixing can be prevented.

As described above, a boundary between proximal heating blocks HB23 and HB24 is arranged on a side close to the transport reference position X with respect to the standard travel position P0 of a paper width direction end of a sheet of A5 paper as a standard size. Accordingly, both protection from an excessive temperature rise and prevention of an occurrence of faulty fixing can be achieved with respect to increased paper transport speeds.

While FIGS. 12A and 12B illustrate an example of transporting A5-size paper as a standard size with respect to a vicinity of a boundary between the heating block HB24 and the heating block HB23 proximal thereto, a similar description also applies to other proximal heating blocks.

As described above, by arranging a boundary between proximal heating blocks on a side close to the transport reference position with respect to the standard travel position of a standard size, both protection from an excessive temperature rise and prevention of an occurrence of faulty fixing can be achieved with respect to increased paper transport speeds.

Third Embodiment

In a third embodiment of the present invention, an example will be described where heating regions of adjacent heating blocks in the paper width direction overlap with each other in a periphery of a boundary between the heating blocks.

Figure 13A:
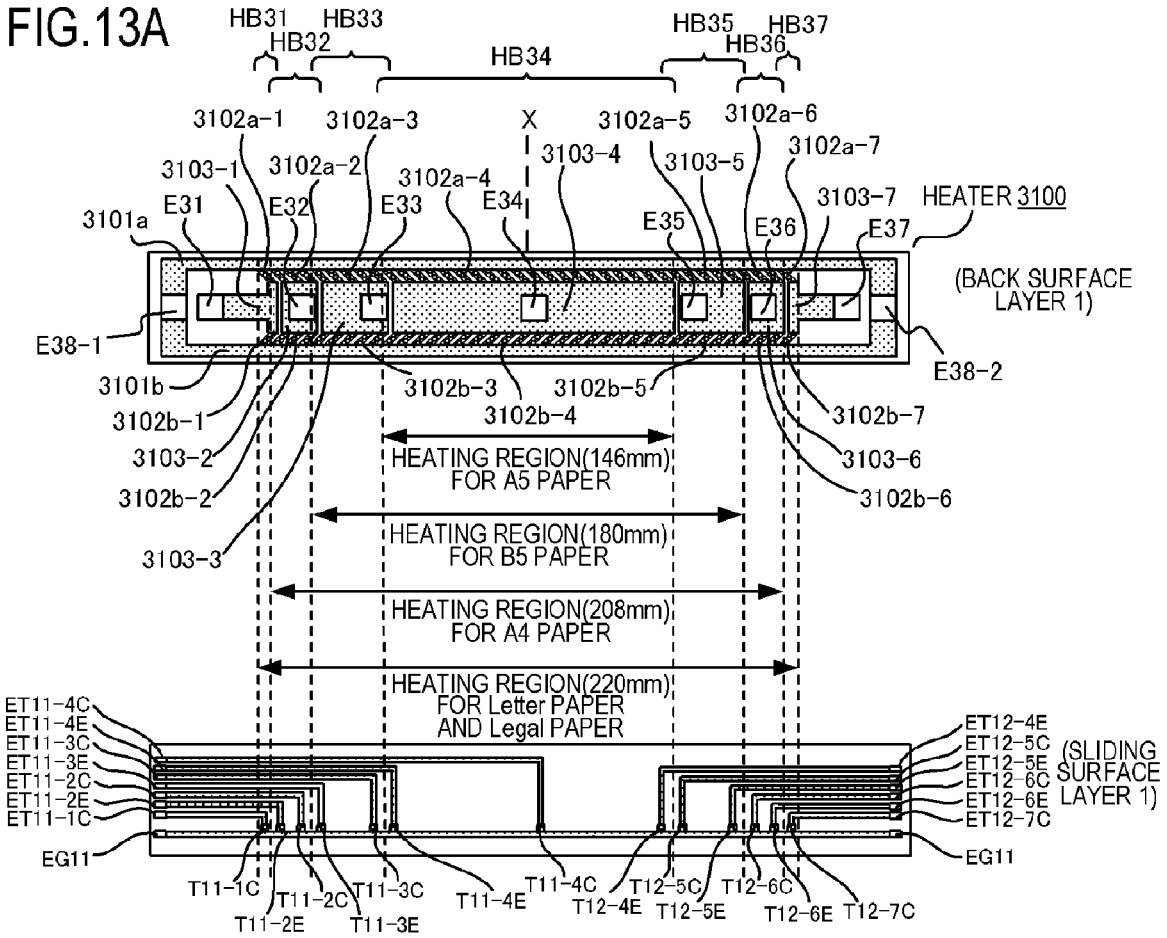
FIGS. 13A and 13B are heater configuration diagrams according to a third embodiment.

FIG. 13A shows a part of a heater configuration diagram according to the third embodiment. A heater 3100 has a similar configuration to the heater 2100 according to the second embodiment with the exception of shapes of heating resistors 3102*a*-1 to 3102*a*-7 and 3102*b*-1 to 3102*b*-7 which form a heating block on the back surface layer 1. Therefore, components of the third embodiment which are similar to those of the second embodiment will be denoted by the same reference numerals and a description thereof will be omitted. It is to be understood that matters not particularly described in the third embodiment are similar to those described in the first and second embodiments.

As shown in FIG. 13A, the heating resistors 3102*a*-1 to 3102*a*-7 and 3102*b*-1 to 3102*b*-7 according to the third embodiment are respectively divided into a plurality of heating element patterns connected in parallel. In the present embodiment, by making the heating element patterns in a parallelogram shape, heating regions are formed so as to overlap with each other in a periphery of a boundary between proximal heating blocks among respective heating blocks HB31 to HB37.

Figure 13B:
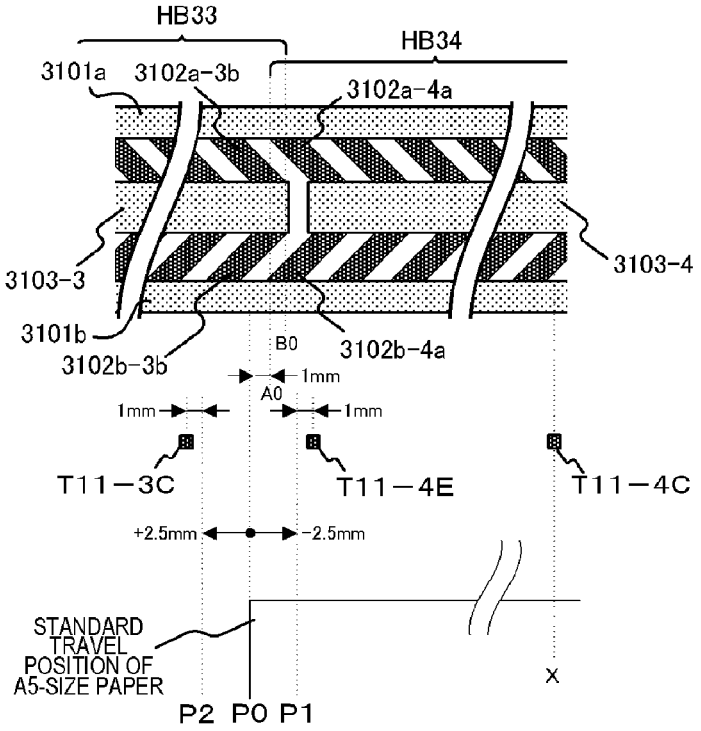

FIG. 13B shows, as a representative example, a configuration near a boundary between the heating block HB34 as a first heating element on a side close to the transport reference position X and the heating block HB33 as a second heating element proximal to the heating block HB34 on a side far from the transport reference. An end of a heating region on a side far from the transport reference position X in the heating block HB34 is a position A0 of a vertex most separated from the transport reference position X in heating element patterns 3102*a*-4*a* and 3102*b*-4*a* which are most separated from the transport reference position X among the plurality of heating element patterns. In addition, an end of a heating region on a side close to the transport reference position X in the heating block HB33 is a position B0 of a vertex nearest to the transport reference position X in the plurality of heating element patterns 3102*a*-3*b* and 3102*b*-3*b*. The position A0 is arranged on a side farther from the transport reference position X than the position B0, and heating regions of the heating block HB34 and the heating block HB33 overlap each other in a periphery of a boundary between the heating block HB34 and the heating block HB33. Forming such heating element patterns enables a drop in an amount of heat generation due to a joint between heating blocks to be prevented.

A similar description can be applied to heating regions in a periphery of boundaries between other proximal heating blocks. In the present embodiment, the regions are formed so as to have the same region widths as in the second embodiment. Specifically, a heating region of the heating block HB34 is set to 146 mm that is shorter than the A5 size (148 mm wide) as a standard size. In addition, a heating region including the heating block HB33 and the heating block HB35 which are arranged on outer sides of the heating block HB34 is set to 180 mm that is shorter than the B5 size (182 mm). Furthermore, a heating region including the heating block HB32 and the heating block HB36 which are arranged on further outer sides is set to 208 mm that is shorter than the A4 size (210 mm wide). A width of all heating blocks including the heating block HB31 and the heating block HB37 is set to 220 mm that is the same as in the second embodiment.

Thermistors in the third embodiment are arranged in the same manner as in the second embodiment so that a monitoring thermistor is arranged in a vicinity on a side close to the transport reference position X than a position moved by 2.5 mm toward a side close to the transport reference position X with respect to a standard travel position of standard size paper. In addition, a control thermistor is arranged in a vicinity on a side farther from the transport reference position X than a position moved by 2.5 mm toward a side far from the transport reference position X with respect to the standard travel position of standard size paper.

The effects of the present invention can also be obtained by using the heater 3100 according to the present embodiment.

Fourth Embodiment

Figure 14A:
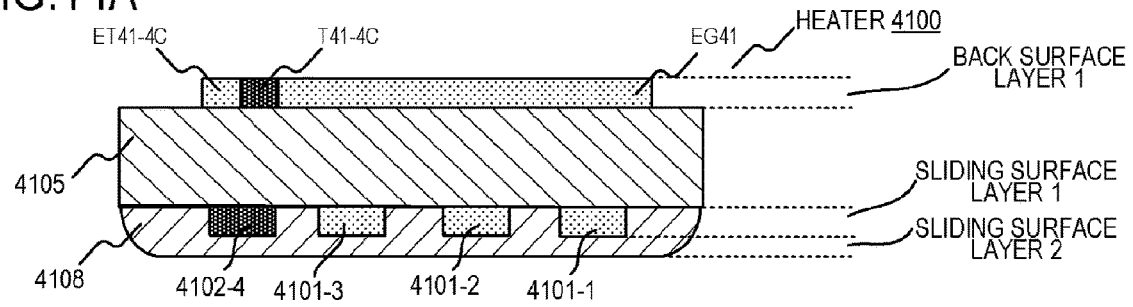
FIGS. 14A and 14B are heater configuration diagrams according to a fourth embodiment.
Figure 14B:
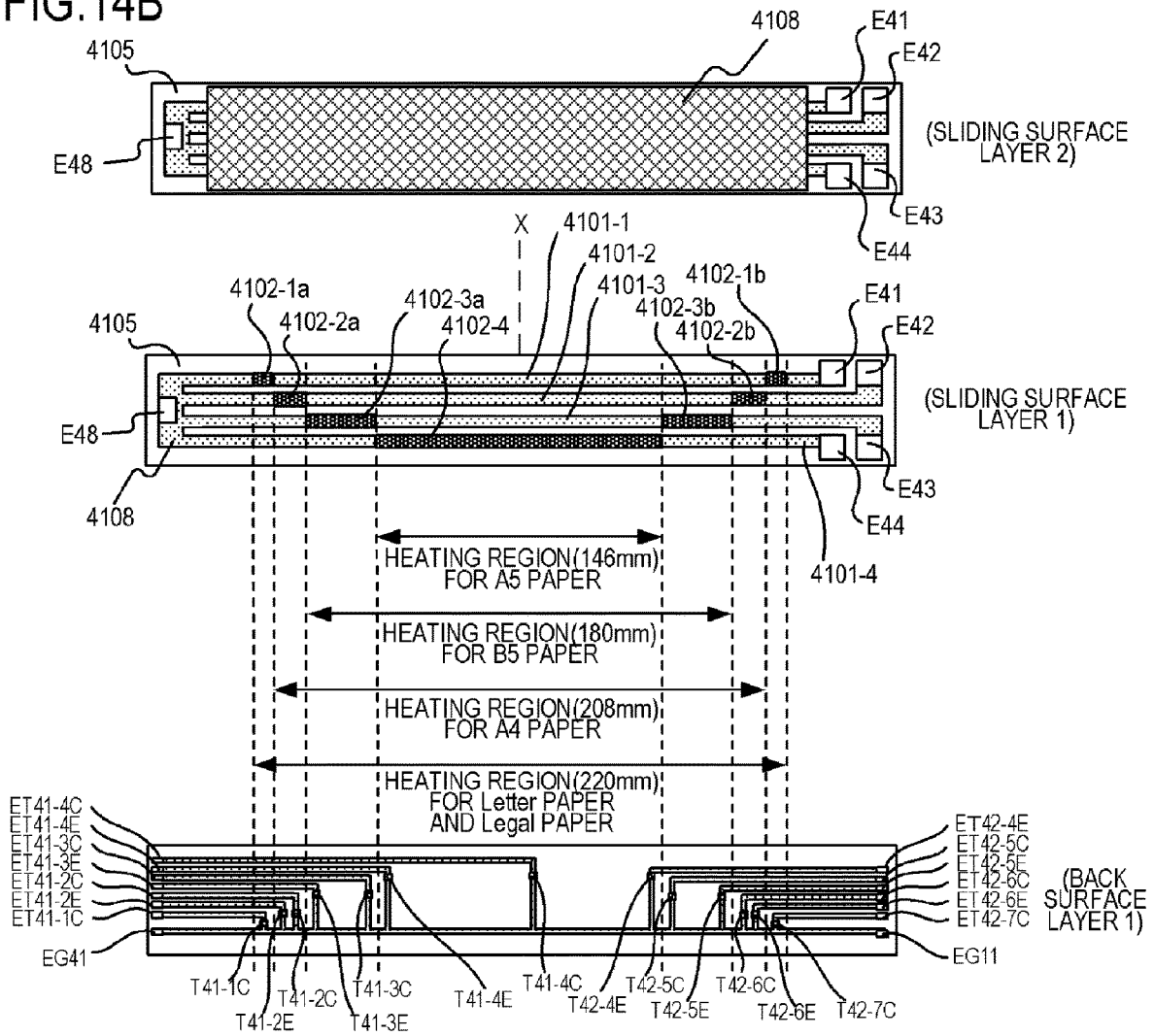

While the first to third embodiments have been described using a configuration example in which heating elements are formed on a back surface side of a heater substrate, the present invention can also be applied to configurations such as a heater 4100 in which heating elements are formed on a side of a sliding surface with the film 202 shown in FIGS. 14A and 14B. It is to be understood that matters not particularly described in the fourth embodiment are similar to those described in the first to third embodiments.

As shown in FIGS. 14A and 14B, the heater 4100 includes a heating resistor (a heating resistor group) 4102-4 which extends in the longitudinal direction as a first heating element. In addition, as a second heating element, a heating resistor 4102-3*a* and a heating resistor 4102-3*b* arranged side by side in the longitudinal direction so as to sandwich a conductor 4101-3 with a same longitudinal length as the heating resistor 4102-4 form a heating resistor group 4102-3. Furthermore, a heating resistor 4102-2*a* and a heating resistor 4102-2*b* arranged side by side in the longitudinal direction so as to sandwich a conductor 4101-2 form a heating resistor group 4102-2. Moreover, a heating resistor 4102-1*a* and a heating resistor 4102-1*b* arranged side by side in the longitudinal direction so as to sandwich a conductor 4101-1 form a heating resistor group 4102-1. The heating resistor groups are arranged approximately parallel to each other on a sliding surface side in a heater transverse direction, and each heating resistor generates heat when energization is performed in a heater longitudinal direction from electrodes E41, E42, E43, and E44 to an electrode E48 via each heating resistor group. Although this is not a configuration in which the respective heating resistors are adjacent to each other in a single straight line, in terms of heating regions in the heater longitudinal direction which heat the recording material P in a fixing nip, the respective heating regions are considered to be proximal to each other.

Thermistors similar to those of the first to third embodiments are printed and formed on a heater back surface side. The thermistors are arranged at similar positions in the heater longitudinal direction to the positions in the first to third embodiments. Positions in the heater transverse direction are arranged on a back surface side corresponding to formation locations of the respective heating resistors.

The heating resistor groups 4102-1 to 4102-3 are respectively connected in series at approximately symmetric positions with respect to the transport reference position X and control heating of the heater by a heater control circuit (not illustrated) in a bilaterally symmetrical manner with respect to the transport direction of the recording material P. In the present embodiment, power is controlled to that an average value of left and right control thermistors such as the control thermistor T41-3C and the control thermistor T42-5C is maintained at a prescribed control temperature. However, power control is not limited thereto and, alternatively, power may be controlled so that a detected temperature of one of the left and right control thermistors is maintained at a prescribed temperature. In the case of a configuration in which left and right heating resistors are simultaneously energized as in the present embodiment, only one of the left and right control thermistors may be arranged, whereby heating of the heater is controlled in a bilaterally symmetrical manner by controlling power so that the control thermistor is maintained at a prescribed temperature.

Effects similar to those of the embodiments described earlier can also be obtained when using the heater 4100 according to the present embodiment. Specifically, when transporting sheets of standard size paper, the need to provide protection from an excessive temperature rise and to deal with faulty fixing is eliminated even when a variation in travel position is taken into configuration and, when transporting sheets of non-standard size paper, protection from an excessive temperature rise can be provided and faulty fixing can be prevented in an appropriate manner.

As described above, using a standard travel position of a paper width direction end of standard size paper as a reference and arranging the respective thermistors at positions based on an allowable range of the travel position, the problems described earlier can be solved.

While a configuration example of a heater to be mounted to an image heating apparatus of which the transport reference position X of the recording material P is center-referenced has been described in the first to fourth embodiments, the present invention is not limited thereto and can also be applied to a so-called one side-referenced image heating apparatus of which the transport reference position X is in a vicinity of a longitudinal direction end of the heater.

In addition, while a thermistor material that is thinly printed and formed on a side of one surface of a heater substrate has been used as the thermistors in the first to fourth embodiments, the present invention is not limited thereto. For example, the present invention can also be applied to an image heating apparatus configured so as to detect a temperature of each heating block by bringing thermistor elements as electric elements into contact with a heater back surface side.

Configurations of the respective embodiments described above can be mutually combined to the greatest extent feasible.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-135990, filed on Jul. 19, 2018, which is hereby incorporated by reference herein in its entirety.

What is claimed is:

1. An image heating apparatus for heating an image formed on a recording material, comprising:

a heater including a plurality of heating elements arranged in a direction perpendicular to a transport direction of the recording material;

a plurality of temperature detecting members for detecting a temperature of a plurality of heated regions that are independently heated by each of the plurality of heating elements; and a control portion which individually controls power to be supplied to the plurality of heating elements, wherein the plurality of heating elements include a first heating element and a second heating element arranged adjacent to the first heating element on a side farther from a transport reference position of the recording material than the first heating element in the direction perpendicular to the transport direction, wherein the plurality of temperature detecting members include a first temperature detecting member provided in correspondence with the first heating element and a second temperature detecting member provided in correspondence with the second heating element, wherein the first temperature detecting member is arranged in the direction, that is perpendicular to the transport direction, at a position that is (i) in a vicinity of an end adjacent to the second heating element among ends in the direction, that is perpendicular to the transport direction, of the first heating element, and (ii) separated from a prescribed reference passing position with respect to a recording material end that passes near a boundary between the first heating element and the second heating element by at least 2.5 mm toward a side close to the transport reference position, and wherein the second temperature detecting member is arranged in the direction, that is perpendicular to the transport direction, at a position that is (iii) in a vicinity of an end adjacent to the first heating element among ends in the direction, that is perpendicular to the transport direction, of the second heating element, and (iv) separated from the reference passing position by at least 2.5 mm toward a far side from the transport reference position from the reference passing position.

2. The image heating apparatus according to claim 1, wherein the first temperature detecting member is arranged at a position within 3 mm on a near side to the transport reference position from the position separated by 2.5 mm, and wherein the second temperature detecting member is arranged at a position within 3 mm on a far side from the transport reference position from the position separated by 2.5 mm.

3. The image heating apparatus according to claim 1, wherein the first temperature detecting member is used for monitoring an excessive temperature rise in the end of the first heating element, and wherein the second temperature detecting member is used for maintaining a temperature of a heated region that is heated by the second heating element among the plurality of heated regions at a prescribed control target temperature.

4. The image heating apparatus according to claim 1, wherein in the direction perpendicular to the transport direction, the end adjacent to the second heating element of the first heating element is positioned on a side closer to the transport reference position than the reference passing position.

5. The image heating apparatus according to claim 1, wherein in the direction perpendicular to the transport direction, the end adjacent to the second heating element of the first heating element has a portion that becomes a position farther from the transport reference position than an end on a side close to the transport reference position of the second heating element.

6. The image heating apparatus according to claim 1, wherein the image heating apparatus further includes a cylindrical film having an outer surface with which the recording material comes into contact.

7. The image heating apparatus according to claim 6, further comprising a roller for forming a nip portion in cooperation with the heater through the film, wherein the heater is provided in an inner space of the film, and wherein the recording material bearing the image is transported and heated at the nip portion.

8. An image forming apparatus, comprising:

an image forming portion which forms an image on a recording material; and a fixing portion which fixes an image formed on the recording material to the recording material, wherein the fixing portion is the image heating apparatus according to claim 1.

9. The image heating apparatus according to claim 7, wherein the heater includes a substrate, and wherein the plurality of heating elements are provided on the substrate.

10. The image heating apparatus according to claim 9, wherein the substrate is made of ceramic.

11. An image heating apparatus for heating an image formed on a recording material, comprising:

a heater including a plurality of heating elements arranged in a direction perpendicular to a transport direction of the recording material, the plurality of heating elements includes a first heating element and a second heating element arranged adjacent to the first heating element in the direction perpendicular to the transport direction;

a first temperature detecting member configured to detect a temperature of a first heated region heated by the first heating element;

a second temperature detecting member configured to detect a temperature of a first heated region heated by the first heating element;

a third temperature detecting member configured to detect a temperature of a second heated region heated by the second heating element; and a control portion configured to control power supplied to the first heating element so that a temperature detected by the first temperature detecting member is maintained a first target temperature and configured to control power supplied to the second heating element so that a temperature detected by the third temperature detecting member is maintained a second target temperature, wherein a boundary between the first heating element and the second heating element is approximately the same position in the direction perpendicular to the transport direction as the edge of the recording material of a predetermined size passes through, wherein the second temperature detecting member is provided at a position nearer to the boundary between the first heating element and the second heating element than the first temperature detecting member in the direction perpendicular to the transport direction, wherein the second temperature detecting member is provided in an area between a first position 2.5 mm closer to the first temperature detecting member than a standard travel positon of the edge of the recording material of the predetermined size and a second position 3.0 mm closer to the first temperature detecting member than the first position in the direction perpendicular to the transport direction, and wherein the third temperature detecting member is provided in an area between a third position 2.5 mm farther from the first temperature detecting member than the standard travel positon of the edge of the recording material of the predetermined size and a fourth position 3.0 mm farther from the first temperature detecting member than the third position in the direction perpendicular to the transport direction.

12. The image heating apparatus according to claim 11, wherein the second heating element is provided at a position farther from a transport reference position of the recording material than the first heating element in the direction perpendicular to the transport direction.

13. The image heating apparatus according to claim 11, wherein the second temperature detecting member is used for monitoring an excessive temperature rise in an end area of the first heating element.

14. The image heating apparatus according to claim 11, further comprising a cylindrical film having an outer surface with which the recording material comes into contact and a roller for forming a nip portion in cooperation with the heater through the film, wherein the heater being provided in an inner space of the film, and wherein the recording material bearing the image is transported and heated at the nip portion.

15. The image heating apparatus according to claim 14, wherein the heater includes a substrate, and wherein the plurality of heating elements are provided on the substrate.

16. The image heating apparatus according to claim 15, wherein the substrate is made of ceramic.

* * * * *